US008191983B2

(12) United States Patent
Yoshida et al.

(10) Patent No.: US 8,191,983 B2
(45) Date of Patent: Jun. 5, 2012

(54) CORRECTION VALUE CALCULATING METHOD AND METHOD OF MANUFACTURING LIQUID EJECTING APPARATUS

(75) Inventors: Takeshi Yoshida, Shiojiri (JP); Masahiko Yoshida, Shiojiri (JP); Michiaki Tokunaga, Matsumoto (JP); Tatsuya Nakano, Shiojiri (JP); Yuji Miyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 248 days.

(21) Appl. No.: 12/750,888

(22) Filed: Mar. 31, 2010

(65) Prior Publication Data

US 2010/0253728 A1 Oct. 7, 2010

(30) Foreign Application Priority Data

Apr. 3, 2009 (JP) ..... 2009-091464

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 7,524,012 | B2 * | 4/2009 | Nunokawa | 347/19 |
| 2002/0175966 | A1 * | 11/2002 | Yoshimura et al. | 347/19 |
| 2010/0201733 | A1 * | 8/2010 | Yoshida et al. | 347/16 |
| 2010/0309273 | A1 * | 12/2010 | Salvestro | 347/188 |

FOREIGN PATENT DOCUMENTS

JP 2008-018639 A 1/2008

* cited by examiner

*Primary Examiner* — Laura Martin
(74) *Attorney, Agent, or Firm* — Nutter McClennen & Fish LLP; John J. Penny, V

(57) ABSTRACT

There is provided a method of calculating a correction value in a liquid ejecting apparatus in which a plurality of heads is arranged in a predetermined direction and each of the heads has a nozzle row in which nozzles ejecting a liquid on a medium are arranged in the predetermined direction. The method includes: forming a first and second pattern by a first and second operation; and calculating, on the basis of the first pattern, a first correction value and, on the basis of the first and second patterns, a second correction valve to line up a landed position of the liquid ejected in the first operation and the second operation.

8 Claims, 13 Drawing Sheets

CORRECTION VALUE CALCULATING METHOD AND METHOD OF MANUFACTURING LIQUID EJECTING APPARATUS

BACKGROUND

1. Technical Field

The present invention relates to a correction value calculating method and a method of manufacturing a liquid ejecting apparatus.

2. Related Art

As a liquid ejecting apparatus, there is known an ink jet printer (hereinafter, referred to as a printer) including a head ejecting ink (liquid) onto a medium. In the head, a nozzle row in which a plurality of nozzles ejecting ink is arranged in a predetermined direction is formed. Therefore, an image is printed on the medium by relatively moving the head and the medium in a direction intersecting a nozzle row direction.

In order to realize high-speed printing in the printer, there has been suggested a printer including a plurality of heads arranged in the nozzle row direction. In some cases, the plurality of heads arranged in the nozzle row direction arranged in zigzags due to the structural restriction thereof (for example, JP-A-2008-18639). In this case, the landed positions of ink ejected from the heads arranged in zigzags may be deviated from each other in the direction intersecting the nozzle row direction. A difference in the landed positions in the direction intersecting the nozzle row direction is corrected on the basis of the central position of each head.

In this correcting method, however, when the heads are mounted to be tilted in the same direction, the dot-formed positions of the nozzles (end nozzles) located at the joints of the heads arranged in the nozzle row direction are considerably deviated from each other in the direction intersecting the nozzle row direction, thereby deteriorating an image.

SUMMARY

An advantage of some aspects of the invention is that it provides a technique capable of suppressing deterioration in an image.

According to an aspect of the invention, there is provided a method of calculating a correction value in a liquid ejecting apparatus in which a plurality of heads is arranged in a predetermined direction and each of the heads has a nozzle row in which nozzles ejecting a liquid on a medium are arranged in the predetermined direction. The method includes: forming a first pattern by a first operation of ejecting the liquid from the plurality of heads while relatively moving the plurality of heads and the medium from one side of an intersecting direction intersecting the predetermined direction to the other side of the intersecting direction; forming a second pattern by a second operation of ejecting the liquid from the plurality of heads while relatively moving the plurality of heads and the medium to the other side of the intersecting direction to the one side of the intersecting direction; calculating, on the basis of the first pattern, a first correction value to line up a landed position of the liquid ejected in the first operation from an end nozzle of a certain head among the plurality of heads on one side of the predetermined direction and a landed position of the liquid ejected in the first operation from an end nozzle of another head on the other side of the predetermined direction, the another head being arranged on the one side of the predetermined direction along with the certain head; and calculating, on the basis of the first and second patterns, a second correction value to line up a landed position of the liquid ejected in the first operation from a middle nozzle of the certain head and a landed position of the liquid ejected from a middle nozzle of the another head ejecting the liquid in the second operation to the landed position of the liquid ejected from the certain head in the first operation.

Other aspects of the invention are apparent from the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview

Figure 1:
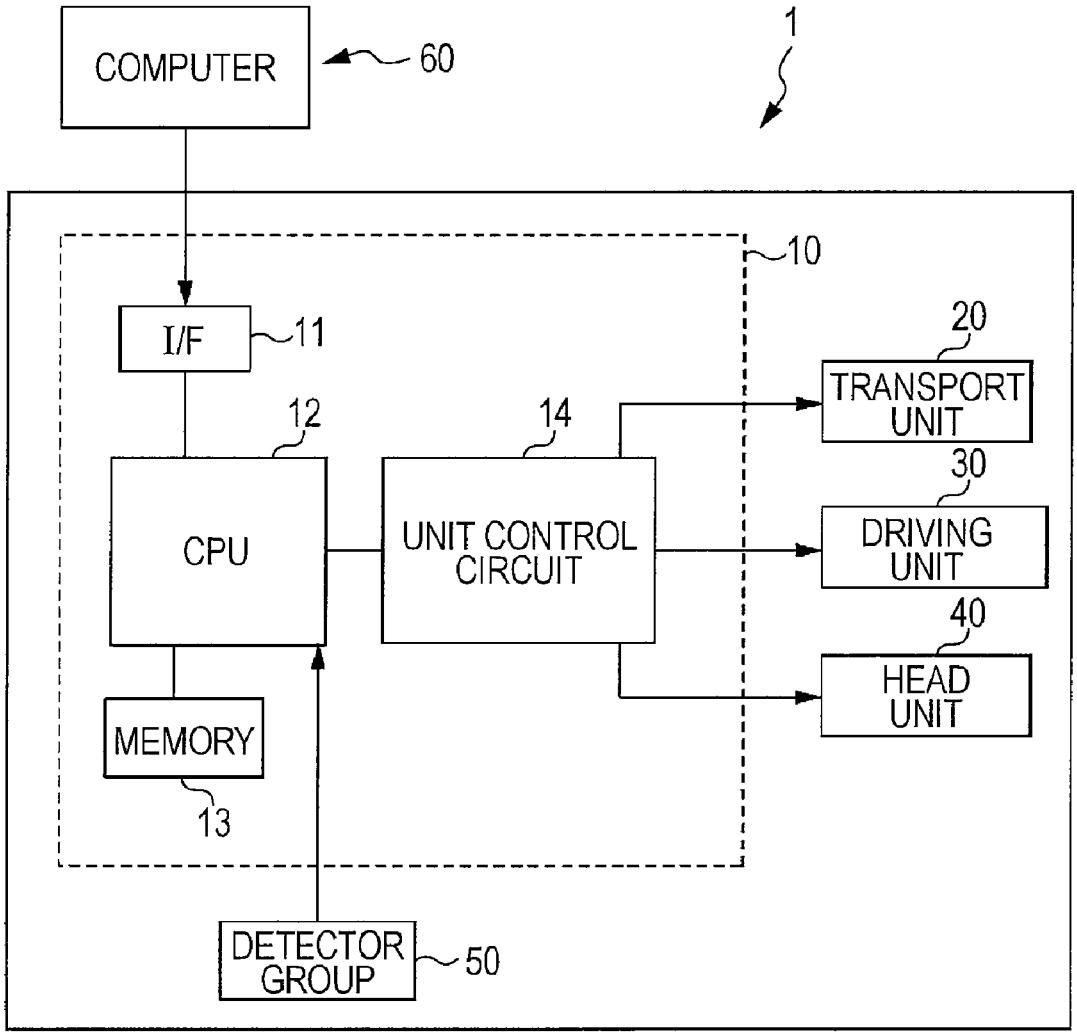
FIG. 1 is a block diagram illustrating the configuration of a printing system.

The following aspects are apparent from the description of the specification and the accompanying drawings.

According to an aspect of the invention, there is provided a method of calculating a correction value in a liquid ejecting apparatus in which a plurality of heads is arranged in a predetermined direction and each of the heads has a nozzle row in which nozzles ejecting a liquid on a medium are arranged in the predetermined direction. The method includes: forming a first pattern by a first operation of ejecting the liquid from the plurality of heads while relatively moving the plurality of heads and the medium from one side of an intersecting direction intersecting the predetermined direction to the other side of the intersecting direction; forming a second pattern by a second operation of ejecting the liquid from the plurality of heads while relatively moving the plurality of heads and the medium to the other side of the intersecting direction to the one side of the intersecting direction; calculating, on the basis of the first pattern, a first correction value to line up a landed position of the liquid ejected in the first operation from an end nozzle of a certain head among the plurality of heads on one side of the predetermined direction and a landed position of the liquid ejected in the first operation from an end nozzle of another head on the other side of the predetermined direction, the another head being arranged on the one side of the predetermined direction along with the certain head; and calculating, on the basis of the first and second patterns, a second correction value to line up a landed position of the liquid ejected in the first operation from a middle nozzle of the certain head and a landed position of the liquid ejected from a middle nozzle of the another head ejecting the liquid in the second operation to the landed position of the liquid ejected from the certain head in the first operation.

According to the method of calculating the correction value, it is possible to prevent the deterioration of an image.

In the method of calculating the correction value, the first correction value may be calculated to line up an average position of landed positions of the liquid ejected in the first operation from a plurality of end nozzles of the certain head on the one side of the predetermined direction and an average position of landed positions of the liquid ejected in the first operation from a plurality of end nozzles of the another head on the other side of the predetermined direction.

According to the method of calculating the correction value, it is possible to prevent the deterioration of an image.

In the method of calculating the correction value, the first correction value is calculated to line up a landed position of the liquid ejected in the first operation from one end nozzle located at the most end of the nozzle row of the certain head on the one side of the predetermined direction among the nozzles ejecting the liquid and a landed position of the liquid ejected in the first operation from one end nozzle located at the most end of the nozzle row of the another head on the other side of the predetermined direction among the nozzles ejecting the liquid.

According to the method of correcting the correction value, it is possible to prevent the deterioration of an image.

In the method of calculating the correction value, in the liquid ejecting apparatus, the plurality of heads may be mounted on one plate, and a tilt of the plate with respect to the predetermine direction may be smaller in the first operation than in the second operation during the relative movement of the plurality of heads and the medium in the intersecting direction.

According to the method of calculating the correction value, the lines formed in the first operation by the plurality of heads are rarely tilted in the predetermined direction.

In the method of calculating the correction value, a total amount of the tilts of the heads with respect to the predetermined direction may be smaller in the first operation than in the second operation during the relative movement of the plurality of heads and the medium in the intersecting direction.

According to the method of calculating the correction value, the lines formed in the first operation by the plurality of heads are rarely tilted in the predetermined direction.

In the method of calculating the correction value, the first pattern is formed by ejecting the liquid to the target position on the medium from an end nozzle of each of the nozzle rows of the plurality of heads in the first operation. The second pattern may be formed by ejecting the liquid to the target position from a middle nozzle of each of the nozzle rows of the plurality of heads in the second operation.

According to the method of calculating the correction method, it is possible to calculate the correction value easily.

In the method of calculating the correction value, the liquid ejecting apparatus may alternately repeat an image forming operation of forming images with a predetermined width by the first and second operation and a transporting operation of relatively moving the plurality of heads and the medium from the other side of the predetermined direction to the one side of the predetermined direction. A third correction value may be calculated to line up the position of an end portion in the direction intersecting the predetermined direction, which is located on the one side of the predetermined direction, in the image with the predetermined width formed in the previous image forming operation and the position of an end portion in the intersecting direction, which is located on the other side of the predetermined direction, in the image with the predetermined width formed in the next image forming operation.

According to the method of correcting the correction value, it is possible to prevent the deterioration of an image.

According to another aspect of the invention, there is provided a method of manufacturing a liquid ejecting apparatus in which a plurality of heads is arranged in a predetermined direction and each of the heads has a nozzle row in which nozzles ejecting a liquid on a medium are arranged in the predetermined direction. The method includes: forming a first pattern by a first operation of ejecting the liquid from the plurality of heads while relatively moving the plurality of heads and the medium from one side of an intersecting direction intersecting the predetermined direction to the other side of the intersecting direction; forming a second pattern by a second operation of ejecting the liquid from the plurality of heads while relatively moving the plurality of heads and the medium to the other side of the intersecting direction to the one side of the intersecting direction; calculating, on the basis of the first pattern, a first correction value to line up a landed position of the liquid ejected in the first operation from an end nozzle of a certain head among the plurality of heads on one side of the predetermined direction and a landed position of the liquid ejected in the first operation from an end nozzle of another head on the other side of the predetermined direction, the another head being arranged on the one side of the predetermined direction along with the certain head; and calculating, on the basis of the first and second patterns, a second correction value to line up a landed position of the liquid ejected in the first operation from a middle nozzle of the certain head and a landed position of the liquid ejected from a middle nozzle of the another head ejecting the liquid in the second operation to the landed position of the liquid ejected from the certain head in the first operation. The landed position of the liquid ejected in the first operation from the end nozzle of the certain head on the one side of the predetermined direction and the landed position of the liquid ejected in the first operation from the end nozzle of the another head on the other side of the predetermined direction are lined up, and the landed position of the liquid ejected in the first operation from the middle nozzle of the certain head and the landed position of the liquid ejected from the middle nozzle of the another head ejecting the liquid in the second operation to the landed position of the liquid ejected from the certain head in the first operation are lined up.

According to the method of manufacturing the liquid ejecting apparatus, it is possible to manufacture the liquid ejecting apparatus capable of preventing the deterioration of an image.

Printing System

Hereinafter, an ink jet printer (hereinafter, referred to as a printer 1) will be described as an example of a liquid ejecting apparatus, and a printing system in which the printer 1 and a computer 60 are connected to each other will be described.

Figure 2A:
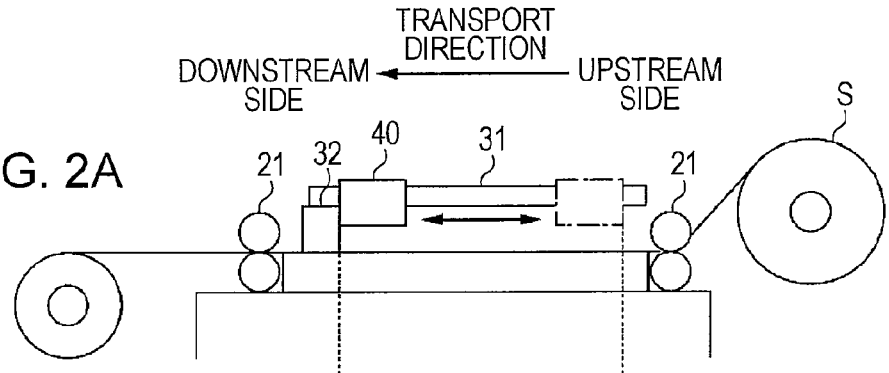
FIG. 2A is a sectional view illustrating a printer.
Figure 2B:
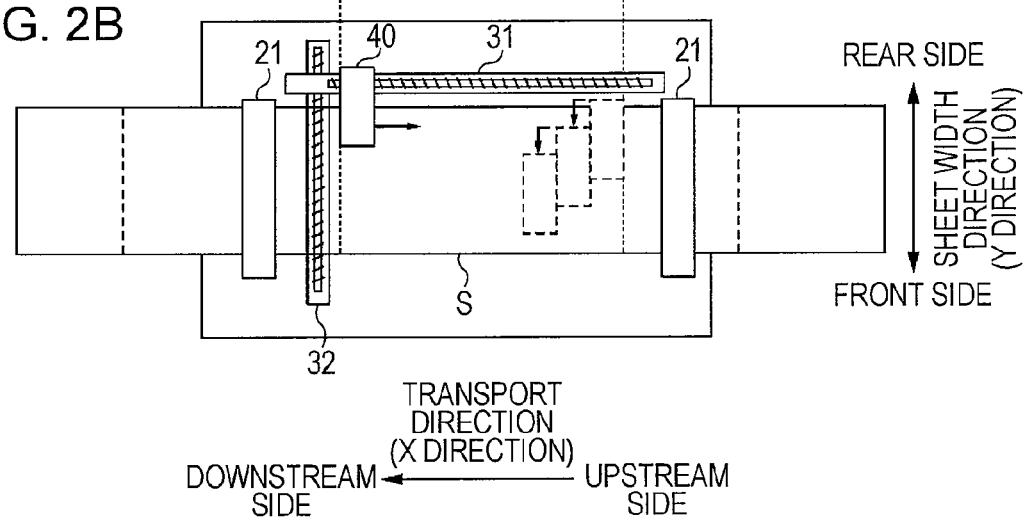
FIG. 2B is a top view illustrating the printer.

FIG. 1 is a block diagram illustrating the configuration of a printing system. FIG. 2A is a schematic sectional view illustrating the printer 1. FIG. 2B is a schematic top view illustrating the printer 1. The printer 1 receiving print data from the computer 60 serving as an external apparatus permits a controller 10 to control respective units (a transporting unit 20, a driving unit 30, and a head unit 40) and form an image on a medium S (continuous sheet) located at a print area. A detector group 50 detects the status of the printer 1 and the controller 10 controls the respective units on the basis of the detection result.

The transporting unit 20 transports the medium S in a direction (hereinafter, referred to as a transport direction), in which the medium S is continuous, from the upstream side to the downstream side. The medium S wound around a roll before printing is supplied to the print area by a transport roller 21 being driven by a motor. Thereafter, the medium S after the printing is wound around a roll by a winding mechanism. In the print area during the printing, the medium S is vacuum-adsorbed from the lower portion and thus the medium S is maintained at a predetermined position.

The driving unit 30 moves the head unit 40 in an X direction corresponding to the transport direction and a Y direction corresponding to a sheet width direction of the medium S. The driving unit 30 includes an X-axis stage 31 moving the head unit 40 in the X direction, a Y-axis stage 32 moving the X-axis stage 31 in the Y direction, and a motor (not shown) moving the X-axis stage and the Y-axis stage.

The head unit 40 configured to form an image includes a plurality of heads 41. A plurality of nozzles serving as an ink ejecting portion is formed on the lower surface of the head 41. An ink chamber storing ink is disposed in each nozzle.

Next, a print sequence will be described. First, the X-axis stage 31 moves the head unit 40 in the X direction (the transport direction) toward the medium S supplied to the print area by the transport unit 20. During the movement of the head unit 40, ink is ejected from the nozzles, and thus a dot line in the X direction is formed on the medium S. Subsequently, the Y-axis stage 32 permits the X-axis stage 31 to move the head unit 40 in the Y direction (width direction), and then the head unit 40 performs printing while being moved again in the X direction. In this way, by alternately repeating a dot forming operation performed when the head unit 40 is moved in the X direction and a movement operation of the head unit 40 in the Y direction, dots are formed at positions different from the positions of the dots formed by the previous dot forming operation to complete an image (image forming operation). When the printing on the medium S supplied to the print area is terminated, a part of the medium S which is not printed is supplied again to the print area by the transport unit 20 (transport operation) to print the image on the medium S in the print area. In the printer 1 according to this embodiment, the image forming operation and the transport operation of the medium S are alternately repeated.

Head 41

Figure 3:
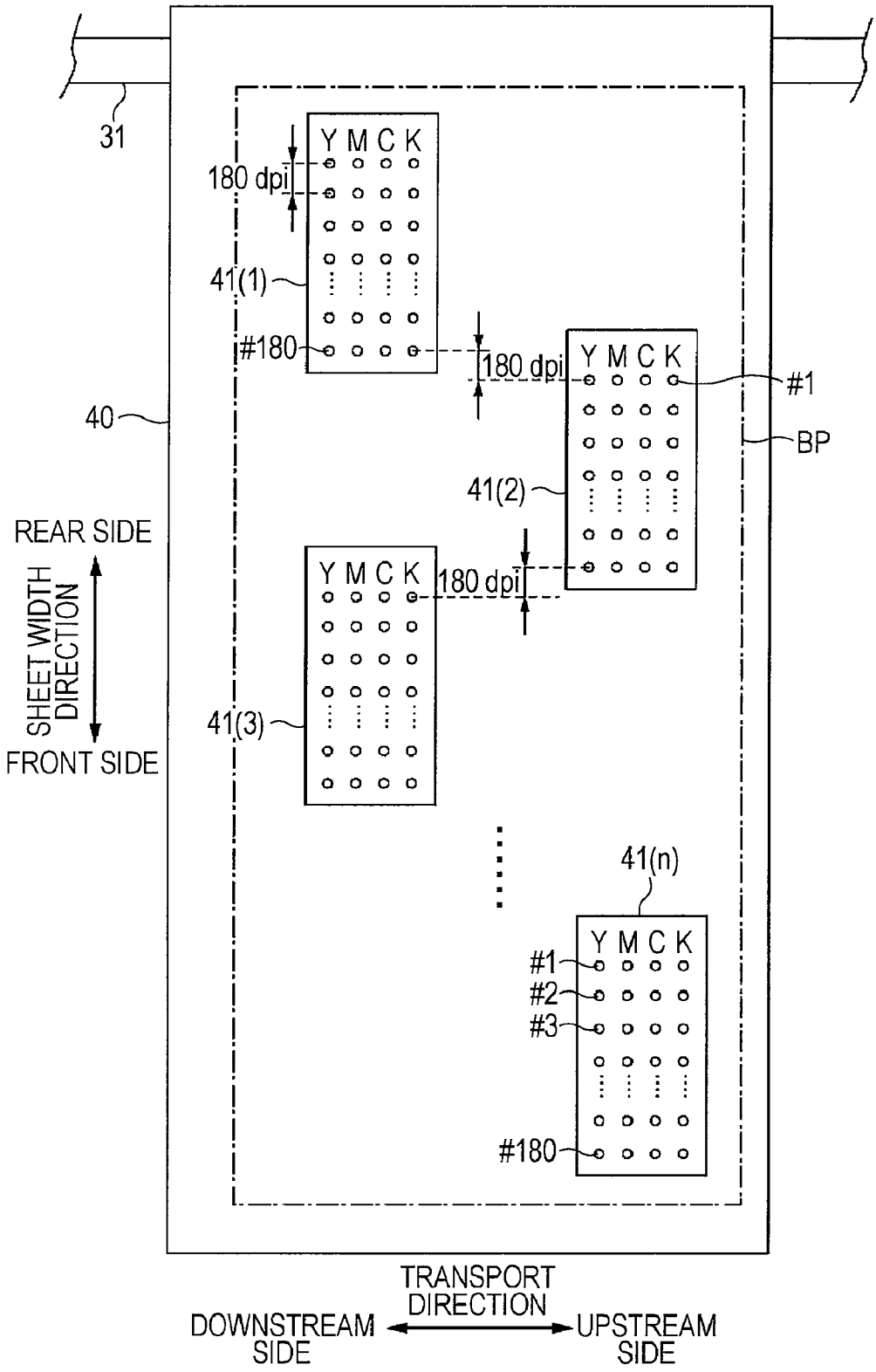
FIG. 3 is a diagram illustrating the arrangement of a plurality of heads of a head unit.

FIG. 3 is a diagram illustrating the arrangement of the plurality of heads 41 in the head unit 40. The nozzle surface is formed on the lower surface of the head unit 40 in effect, but FIG. 3 is the diagram illustrating the nozzles viewed in an imaginary way in a plan view (the same is applied to the following drawings). In the configuration in which the plurality of nozzles is arranged in the sheet width direction, an image of a large width can be printed by one-time movement of the head unit 40 in the transport direction. In this way, the printing can be realized at a high speed. However, the long head cannot be realized due to a problem with manufacture. In the printer 1, the plurality of short heads 41 (n heads) are arranged in the sheet width direction. As illustrated, the plurality of heads 41 is disposed in a base plate BP. In a manufacturing process of the printer 1, the base plate BP (corresponding to a plate) mounted with the plurality of heads 41 is mounted in a main body of the printer 1.

A yellow nozzle row Y ejecting yellow ink, a magenta nozzle row M ejecting magenta ink, a cyan nozzle row C ejecting cyan ink, and a black nozzle row K ejecting black ink are formed on the nozzle surface of each head 41. Each nozzle row has 180 nozzles and the 180 nozzles are arranged at a uniform interval (180 dpi) in the sheet width direction. As illustrated, numerals (#1 to #180) are given in order of small number from the nozzles on the rear side in the sheet width direction.

Of two heads (for example, heads 41(1) and 41(2)) adjacent to each other in the sheet width direction, the most front nozzles #180 of the head 41(1) on the rear side and the most rear nozzles #1 of the head 41(2) on the front side are arranged also in the uniform interval (180 dpi). That is, on the lower surface of the head unit 40, the nozzles are arranged in the uniform interval (180 dpi) in the sheet width direction. Alternatively, the end nozzles of other heads 41 may overlap each other.

As shown in FIG. 3, in order for the interval of the end nozzles of other heads 41 to be set to 180 dpi, it is necessary to arrange the heads 41 in zigzags due to the structural problem of the heads 41. In this way, when the plurality of heads 41 is arranged in zigzags, in order to form a straight line in the sheet width direction, it is necessary to correct ejection time, at which the liquid is ejected from a head 41 (an odd-numbered head, for example, the head 41(1)) on the downstream side in the transport direction, and ejection time, at which the liquid is ejected from a head 41 (an even-numbered head, for example, the head 41(2)) on the upstream side in the transport direction. Hereinafter, a method of correcting the ejection time (dot-formed position), at which the liquid is ejected from a head 41 deviated in the transport direction, will be described.

Comparative Example Method of Correcting Dot-Formed Position

Figure 4:
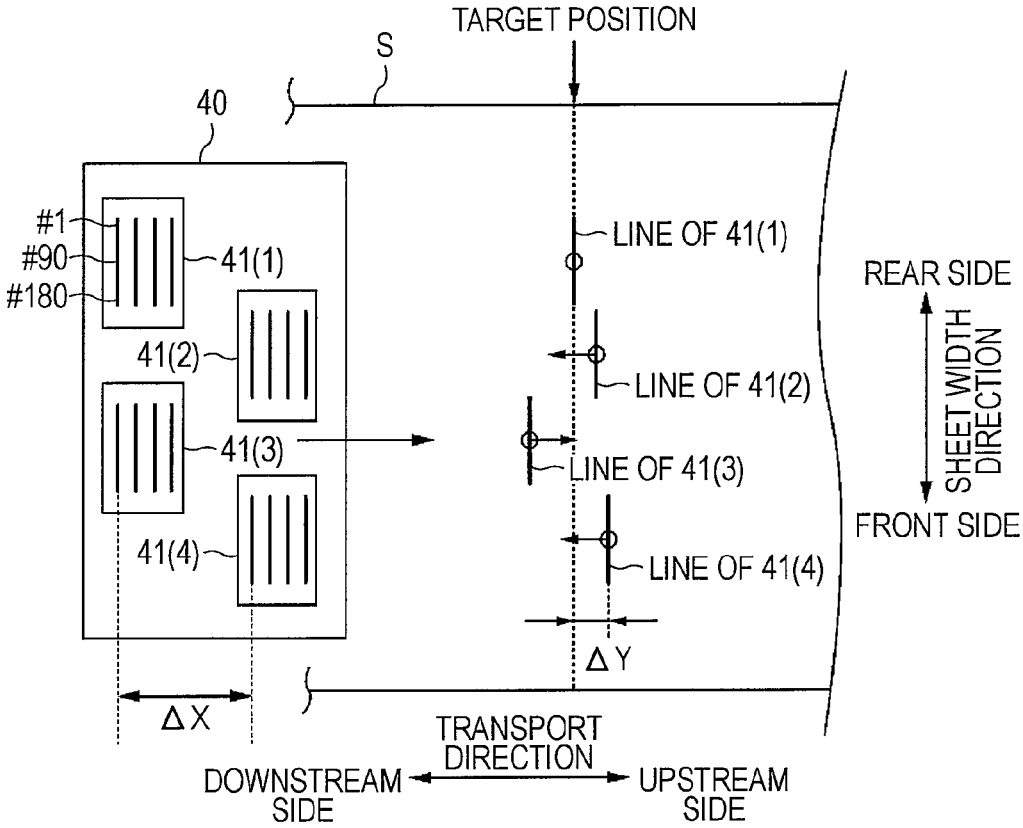
FIG. 4 is a diagram illustrating a method of correcting a dot-formed position according to a comparative example.

FIG. 4 is a diagram illustrating a method of correcting the dot-formed position according to a comparative example. Hereinafter, for easy description, it is assumed that the head unit 40 includes only four heads 41. A deviation amount in the transport direction between the heads 41(1) and 41(3) on the downstream side in the transport direction and the heads 41(2) and 41(4) on the upstream side in the transport direction is known in advance in terms of design. As illustrated, a difference between the arrangement position of the heads 41 on the downstream side in the transport direction and the arrangement position of the heads 41 on the upstream side in the transport direction is referred to as a "deviation amount ΔX".

For example, when ink is ejected to the same position of the medium S in the transport direction from the upstream heads 41 and the downstream heads 41 during the movement of the head unit 40 from the downstream side to the upstream side in the transport direction, the upstream heads 41(2) and 41(4) face the ejecting target position earlier than the downstream heads 41(1) and 41(3). Then, after the upstream heads 41(2) and 41(4) face the ejecting target position and then the head unit 40 is moved by the "deviation amount ΔX" in the transport direction, the downstream heads 41(1) and 41(3) face the ejecting target position.

Accordingly, in terms of the design, after the liquid is ejected from the upstream heads 41(2) and 41(4) and then time necessary for moving the head unit 40 by the deviation amount ΔX in the transport direction elapses, the liquid is ejected from the downstream heads 41(1) and 41(3). In this way, the dot-formed position in the transport direction by the upstream heads 41(2) and 41(4) and the dot-formed position in the transport direction by the downstream heads 41(1) and 41(3) can be lined up. Then, a straight line can be formed in the sheet width direction by the plurality of heads 41 arranged in zigzags in the head unit 40.

However, in effect, the dots may be formed at positions deviated from the ejecting target positions at the designed ejection time due to an installation error caused when the heads 41 are mounted on the base plate BP or a difference in the ejection characteristics of the respective heads 41. A test pattern is printed by the printer 1 at the time of manufacturing the printer 1, and a correction value of the dot-formed position in the transport direction of each head 41 is calculated on the basis of the test pattern.

Hereinafter, a method of calculating the correction value of the dot-formed position will be described according to a comparative example. FIG. 4 shows a test pattern formed on the medium S located at the print area. In order to form such a test pattern, a target position on the medium S is first set. Then, the ink is ejected from the respective heads 41 at the designed ejection time so that ink droplets ejected from the respective heads 41 arranged in zigzags are landed on the target position. Here, the ink droplets are ejected from all of the 180 nozzles of each head 41 to form the test pattern, but the invention is not limited thereto. For example, the ink droplets may be ejected from the every other nozzle. As a consequence, as shown in FIG. 4, a dot row in the sheet width direction (nozzle row direction) is formed by the heads 41(1) to 41(4).

Specifically, in the test pattern, a line formed by the first head 41(1) is formed without being deviated from the target position. From this point, it is apparent that it is not necessary to correct the ejection time of the first head 41 from the designed ejection time.

On the other hand, lines formed by the second head 41(2) and the fourth head 41(4) are deviated from the target position toward the upstream side in the transport direction and thus are formed over the target position. Accordingly, it can be known that it is necessary for the second head 41(2) and the fourth head 41(4) to eject the ink droplets at time earlier than the designed ejection time.

On the contrary, a line formed by the third head 41(3) is deviated from the target position toward the downstream side in the transport direction and thus are formed in the front of the target position. Accordingly, it can be known that it is necessary for the third head 41(3) to eject the ink droplet at time later than the designed ejection time.

Then, by acquiring a deviation amount between the target position and the actually formed line from the result of the test pattern, it can be known a correction degree of the ejection time. For example, the line formed by the fourth head 41(4) in FIG. 4 is deviated from the target position by a "deviation amount ΔY" toward the upstream side in the transport direction. Accordingly, the ejection time of the fourth head 41(4) may be advanced than the designed ejection time by a time during which the head unit 40 moves by the "deviation amount ΔY". In this way, the line formed by the fourth head 41(4) can be at the target position.

A time necessary for moving the head unit 40 by the "deviation amount ΔY (a difference between the position of the line formed as the test pattern and the target position)" corresponds to a correction value by which the actually ejection time is advanced or delayed from the designed ejection time. In order to acquire the deviation amount ΔY, a difference between the target position and the position of the line may be calculated from data obtained by allowing a scanner to read the printed test pattern, or a difference between the target position and the position of the line may be measured from the test pattern.

In the comparative example, when the deviation amount ΔY between the target position and the position of the line formed by each head 41 is acquired on the basis of the central portion of the lines formed by the respective heads 41. That is, the ejection time of each head 41 is adjusted by the deviation amount ΔY in the transport direction between the target position and the line portion (a portion which is surrounded by a circle in FIG. 4) formed by the central portion (for example, nozzle #90) of the nozzle row. In this way, the dot-formed position of each head 41 can be corrected in accordance with the ejection characteristics or the installation error. When the head unit 40 moves in both directions of the transport direction to form an image (when both-direction printing is performed), as in FIG. 4, a test pattern may be formed by the head unit 40 moving from the downstream side to the upstream side in the transport direction and a test pattern may be formed by the head unit 40 moving from the upstream side to the downstream side in the transport direction.

Figure 5:
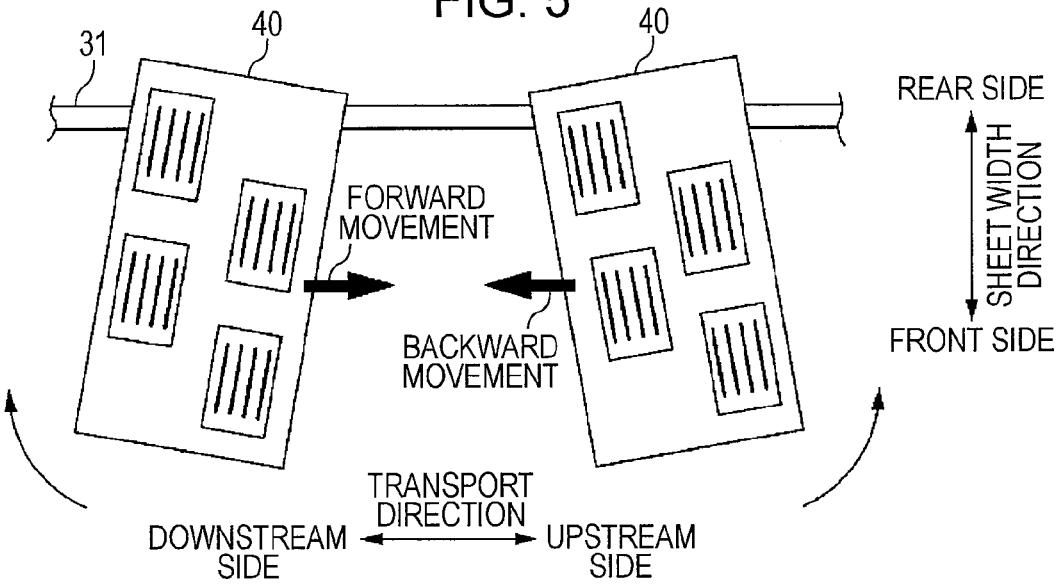
FIG. 5 is a diagram illustrating a head unit tilted during movement of the head unit in a transport direction.

FIG. 5 is a diagram illustrating the head unit 40 tilted during the movement thereof in the transport direction according to this embodiment. In the printer 1 according to this embodiment, as shown in FIGS. 2B and 3, the head unit 40 is moved in the transport direction only by the X-axis stage 31 (a driving shaft mounted with a driving motor) on the rear side in the sheet width direction. That is, only one end portion of the head unit 40 in the sheet width direction is driven. Moreover, since the plurality of heads 41 are arranged in the transport direction in the head unit 40, the head unit 40 is relatively weighty and long in the sheet width direction.

For this reason, when the head unit 40 is moved in the transport direction, a strong force of inertia occurs in the end portion of the head unit on the opposite side (the front side in the sheet width direction) of the X-axis stage 31, and thus the head unit 40 may easily be tilted, as illustrated. Specifically, when the head unit 40 is moved from the downstream side to the upstream side in the transport direction, the head unit 40 becomes tilted clockwise. When the head unit 40 is moved from the upstream side to the downstream side in the transport direction, the head unit 40 becomes tilted counterclockwise. That is, when the head unit 40 is moved in different directions, the head unit 40 becomes tilted in different directions. FIG. 5 shows that the head unit 40 becomes considerably tilted for clear description, but the head unit 40 becomes slightly tilted in effect.

The head unit 40 becomes easily tilted in the sheet width direction during the movement of the head unit 40 with respect to the transport direction, when only one side of the head unit 40 is driven. In particular, when a guide rail or the like is not disposed on the opposite side of the X-axis stage 31 (the driving shaft), as in the printer 1 according to this embodiment, the head unit 40 becomes tilted more easily.

Figure 6A:
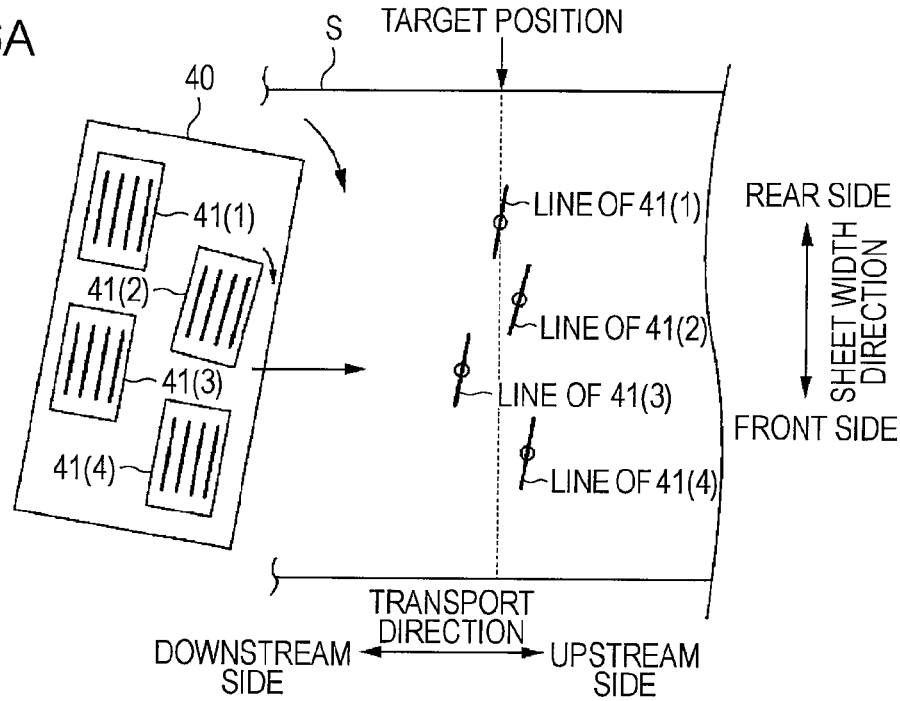
FIG. 6A is a diagram illustrating a test pattern formed by the head unit tilted.
Figure 6B:
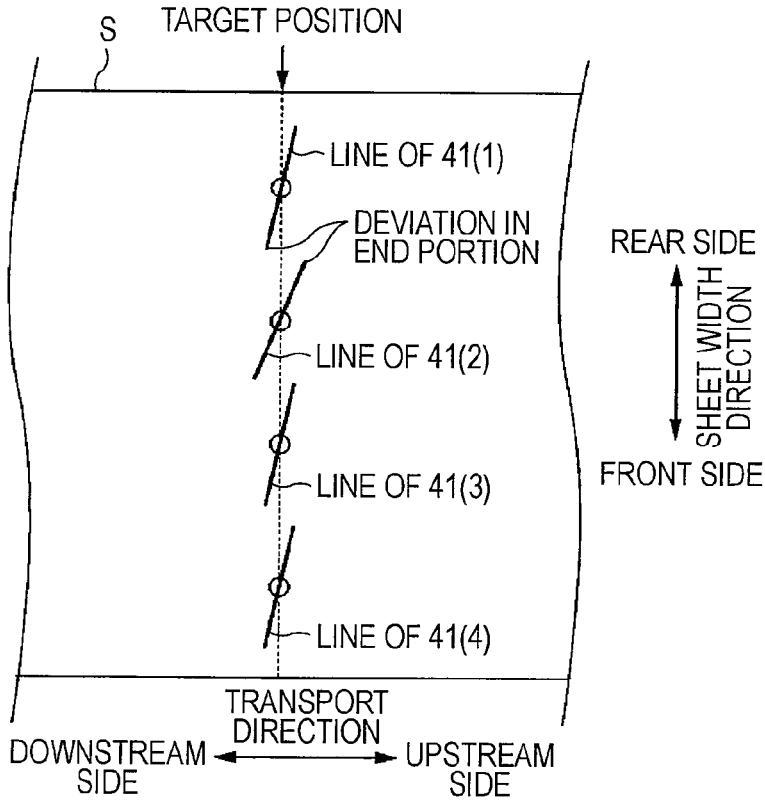
FIG. 6B is a diagram illustrating lines corrected by a correcting method according to a comparative example.

FIG. 6A is a diagram illustrating a test pattern formed by the head unit 40 tilted during the movement thereof in the transport direction. FIG. 6B is a diagram illustrating lines corrected by a correcting method on the basis of the result of the test pattern of FIG. 6A according to a comparative example. FIGS. 6A and 6B show the test pattern formed when the head unit 40 is moved from the downstream side to the upstream side in the transport direction (hereinafter, also referred to forward movement). As shown in FIG. 5, the head unit 40 becomes easily tilted clockwise at the time of forward movement. Therefore, the lines formed as the test pattern become also tilted clockwise with respect to the sheet width direction. Moreover, not only the entire head unit 40 becomes tilted, but individual heads 41 may become tilted due to the installation error or the like. In this case, the tilts of the lines formed by the individual heads 41 become also different.

In the method of correcting the dot-formed position according to the comparative example, the deviation amount (the deviation amount from the target position) in the transport direction is corrected on the basis of the central portion (the portion surrounded by a circle in the drawing) of the line formed as the test pattern by each head 41. For example, the central portion of the line formed by the second head 41(2) is located on the upstream side in the transport direction. Therefore, when the ejection time is corrected so that the central portion of the line formed by the second head 41(2) is located at the target position, the entire line formed by the second head 41(2) is thus deviated toward the downstream side in the transport direction, as shown in FIG. 6B. For this reason, in the correcting method according to the comparative example, as shown in FIG. 6B, the central portion of the line formed by each head 41 is located at the straight line of the target position.

However, since the entire portions of the line formed by the head 41 tilted with respect to the sheet width direction are located at different positions in the transport direction, the deviation amounts with respect to the target position are also different from each other. For example, in FIG. 6B, the central portion of the line formed by the first head 41(1) is located at the target portions, but the upper end portion (the end portion on the rear side) of the line is located on the upstream side of the target position in the transport direction and the lower end portion (the end portion on the front side) of the line is located on the downstream side of the target position in the transport direction.

For this reason, when the lines formed in the sheet width direction are tilted in the same direction, joints of the lines are considerably deviated from each other. For example, the end portion of the line of the first head 41(1) close to the line of the second head 41(2) is located on the downstream side of the target position in the transport direction, whereas the end portion of the line of the second head 41(2) close to the line of the first head 41(1) is located on the upstream side in the transport direction. The deviation in the joints of the lines formed by the respective heads 41 in the transport direction results in deviation in an image formed by the heads 41 in the transport direction. Consequently, the image may deteriorate.

When the entire head unit 40 (the base plate BP) becomes tilted during the movement of the head unit 40, as in FIG. 5, or the heads 41 arranged in the sheet width direction become tilted in the same direction, the lines formed in the sheet width direction become tilted in the same direction. Consequently, in the method of correcting the dot-formed position according to the comparative example, the image may deteriorate particularly in the joints of the heads 41. Since the printer 1 according to this embodiment drives and moves only one side of the head unit 40 in the transport direction, as described above, the heads 41 arranged in the head unit 40 (the base plate BP) may become tilted easily upon forming dots, as in FIG. 5.

In this embodiment, it is designed to prevent the deterioration in an image by suppressing a difference in the transport direction between the positions of the dots formed by the joints (end nozzles) of the plurality of heads 41 arranged in the nozzle row direction (the sheet width direction).

Embodiment:Method of Correcting Dot-Formed Position

Figure 7:
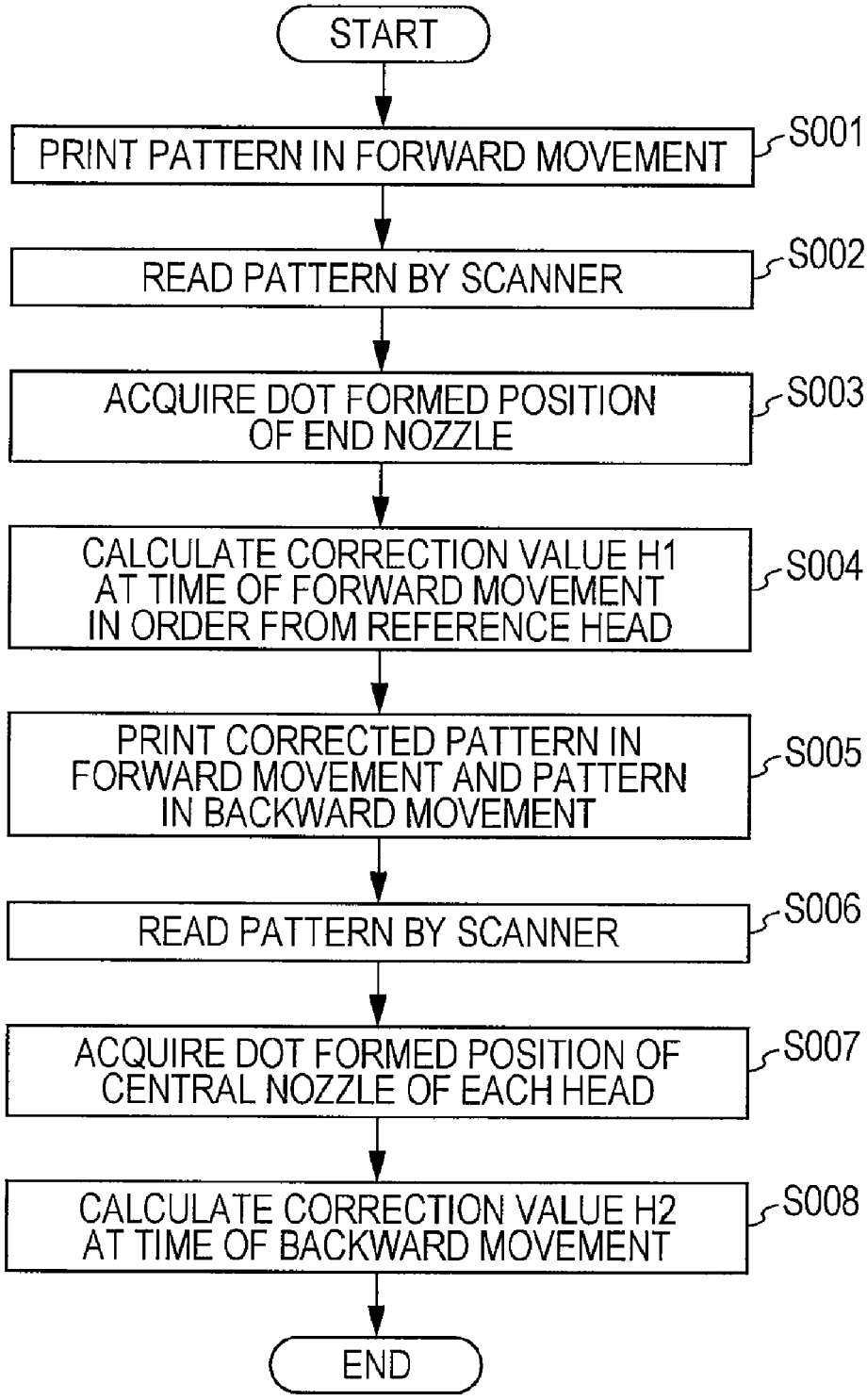
FIG. 7 is a flowchart illustrating a method of correcting a dot-formed position according to the embodiment.
Figure 8A:
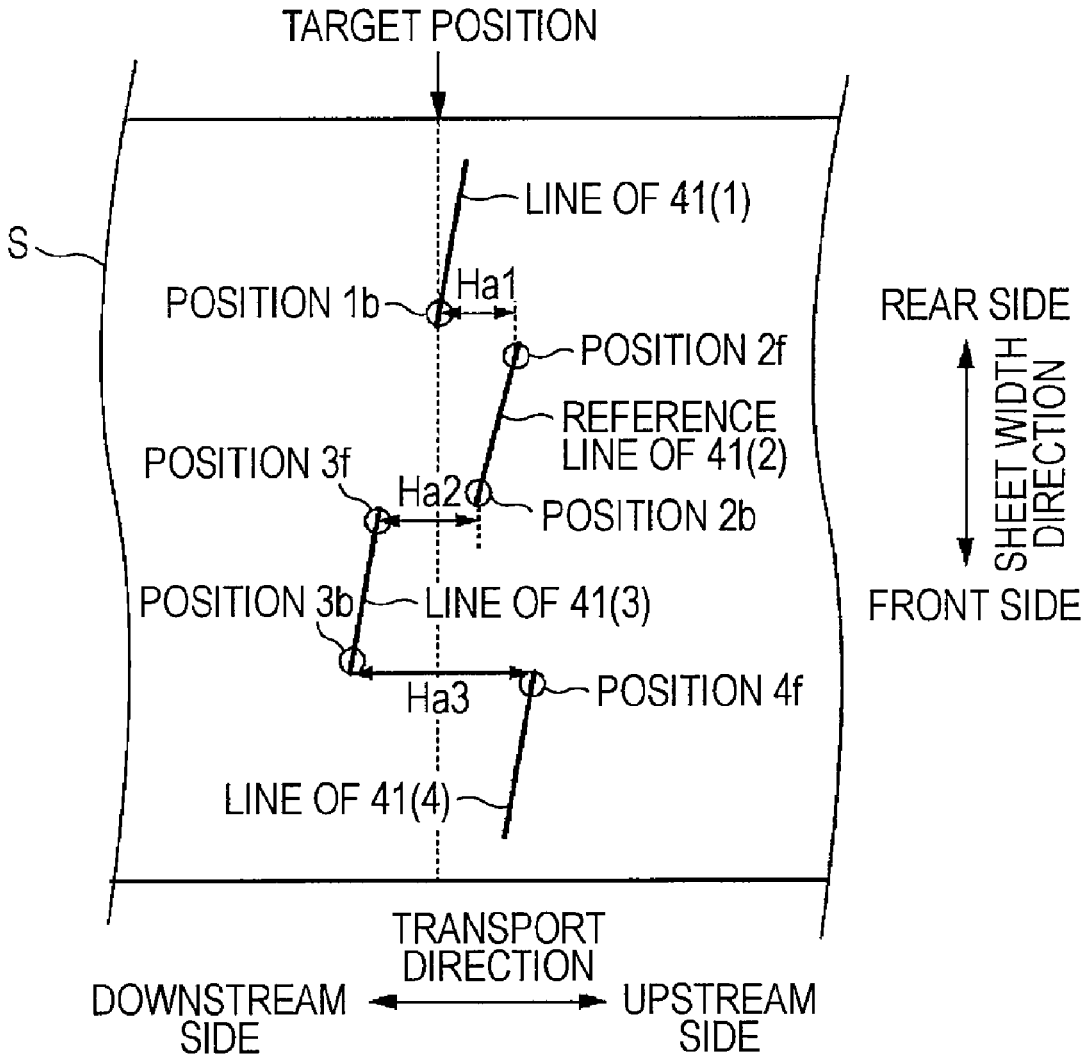
FIG. 8A is a diagram illustrating a test pattern formed by the head unit at the time of forward movement.

FIG. 7 is a flowchart illustrating the method of correcting the dot-formed position according to this embodiment. FIG. 8A is a diagram illustrating a test pattern (as in FIG. 6A) formed by the head unit 40 at the time of forward movement. In order to calculate the correction value used to correct the ejection time of the heads 41 of the head unit 40 in accordance with the characteristics of the printer 1, as described above, a test pattern is printed in effect by the printer 1 in a process of manufacturing the printer 1. The dot-formed positions in the transport direction by the heads 41 arranged in zigzags and having different ejection characteristics are lined up on the basis of the correction value.

The printer 1 according to this embodiment prints an image, not only when the head unit 40 is moved from the downstream side (one side) to the upstream side (the other side) in the transport direction (intersecting direction) (at the time of forward movement, which corresponds to a first operation), but when the head unit 40 is moved from the upstream side to the downstream side in the transport direction (at the time of backward movement, which corresponds to a second operation). Accordingly, a correction value H1 (corresponding to a first correction value) regarding the dot-formed position of each head 41 at the time of forward movement is calculated, and a correction value H2 (corresponding to a second correction value) regarding the dot-formed position of each head 41 at the time of backward movement is calculated. Between the time of forward movement and the time of backward movement, the printer 1 performs a printing method in which the head unit 40 is not moved in the sheet width direction.

The correction value H1 at the time of forward movement is first calculated. Then, the head unit 40 at the time of forward movement forms a test pattern (first pattern) (S001). Like the test pattern of the comparative example, the ejection time of the heads 41(2) and 41(4) on the upstream side in the transport direction and the ejection time of the heads 41(1) and 41(3) on the downstream side in the transport direction are adjusted by the designed deviation amount (ΔX in FIG. 4) to eject the ink droplets from the heads 41 belonging to the head unit 40 so that the dots are formed at the target position from the heads 41 arranged in zigzags. As a consequence, the lines are formed on the medium S in the print area by the heads 41, as shown in FIG. 8A.

In the printer 1 according to this embodiment, as described in FIG. 5, the head unit 40 easily becomes tilted clockwise at the time of forward movement and all of the plurality of heads 41 belonging to the head unit 40 become tilted clockwise upon forming the test pattern. For this reason, the lines formed as the test pattern by the heads 41 at the time of forward movement become tilted clockwise with respect to the sheet width direction, as shown in FIG. 8A. Moreover, the lines become tilted not only when the head unit 40 is tilted in the transport direction but the heads 41 are tilted due to the installation error or the like. The test pattern formed in this way at the time of forward movement is read by a scanner to acquire the test pattern as reading data (S002).

In the correcting method according to the above-described comparative example, the difference between the target position and the dot-formed position of each head 41 is corrected on the basis of the central portion of the line formed by each head 41, as shown in FIG. 6B. However, when the heads 41 arranged to be adjacent to each other in the sheet width direction become tilted in the same direction, the dot-formed position of the joints of the head 41, that is, the dot-formed position of the end nozzles is deviated in the transport direction, thereby deteriorating the image formed in the joints of another head 41.

In this embodiment, a difference between the dot-formed positions formed in the transport direction by the heads 41 adjacent to each other in the sheet width direction (predetermined direction) is corrected on the basis of the end portions of the lines formed by the adjacent heads 41. The end portion of the line is a dot formed by an end nozzle (for example, nozzle #1 or #180 in FIG. 3) of the nozzle row of each head 41. That is, the first correction value H1 at the time of forward movement is calculated so that the dot-formed positions in the transport direction at the joints of the heads 41 adjacent to each other in the sheet width direction are lined up.

In this way, the position of the end portion of the line formed by each head 41 is acquired on the basis of the result obtained by reading the test pattern at the time of the forward movement by the scanner (S003). The invention is not limited to the method of reading the test pattern by the scanner, but the position of the end portion of the line formed on the medium S by each head 41 may be measured.

Specifically, the head 41 serving as a reference head is first determined among the heads 41(1) to 41(4) arranged in the sheet width direction. It is preferable that the head 41 located in the middle in the sheet width direction is determined as the reference head 41. Here, the second head 41(2) serves as the reference head. The position of the end portion of the line formed by the reference head 41(2) is acquired from the reading data of the test pattern. An average position of the positions of the dots formed in the transport direction by the plurality of end nozzles of the nozzle row is calculated as a "position of the end portion of the line". For example, the average position of the dot-formed positions of ten nozzles #1 to #10 is calculated as the position of the end portion of the line on the rear side in the sheet width direction. The average position of the dot-formed positions of ten nozzles #171 to #180 is calculated as the position of the end portion of the line on the front side in the sheet width direction. In particular, in the line formed by the head 41 tilted with respect to the sheet width direction, the positions of the dots formed in the transport direction by the ten end nozzles become also different.

Specifically, there is first calculated a position "2*f*" of the end portion of the line formed in the transport direction by the end nozzles (#1 to #10) of the second head 41(2) serving as the reference head on the rear side in the sheet width direction. In addition, there is calculated a position "1*b*" of the end portion of the line formed in the transport direction by the end nozzles on the front side (close to the second head) in the transport direction in the first head 41(1) arranged on the rear side in the sheet width direction with respect to the second head 41(2). In this embodiment, the ejection times of the two heads 41(1) and 41(2) are corrected to line up the dot-formed position "1*b*" of the end nozzles of the first head 41(1) on the front side and the dot-formed position "2*f*" of the end nozzles of the second head 41(2) on the rear side in the transport direction.

The line formed by the first head 41(1) is located on the downstream side in the transport direction from the line formed by the second head 41(2) serving as the reference head. Therefore, the ejection time of the first head 41(1) is corrected to form the line formed by the first head 41(1) toward the upstream side in the transport direction by a difference "Ha1" between the dot-formed position 2*f* formed by the end nozzles of the second head 41(2) and the dot-formed position 1*b* of the end nozzles of the first head 41(1). That is, the ejection time of the first head 41(1) is delayed than the ejection time of the second head 41(2) by a time necessary for moving the head unit 40 by the "difference Ha1". In this way, it is possible to line up the dot-formed position in the transport direction by the end nozzles (that is, the end nozzles close to the second head) of the first head 41(1) on the front side in the sheet width direction and the dot-formed position in the transport direction by the end nozzles (that is, the end nozzles close to the first head) of the second head 41(2) on the rear side in the sheet width direction.

There is calculated a position "2*b*" of the end portion of the line formed in the transport direction by the end nozzles (#171 to #180) of the second head 41(2) serving as the reference head on the front side in the sheet width direction. In addition, there is calculated a position "3*f*" of the end portion of the line formed in the transport direction by the end nozzles on the rear side in the transport direction in the third head 41(3) arranged on the front side in the sheet width direction with respect to the second head 41(2). Then, there is calculated a difference "Ha2" between the dot-formed position 2*b* of the second head 41(2) serving as the reference head on the front side in the sheet width direction and the dot-formed position 3*f* of the third head 41(3) on the rear side in the sheet width direction. The line formed by the third head 41(3) is located on the downstream side in the transport direction from the second head 41(2). That is, the ejection time of the third head 41(3) is delayed than the ejection time of the second head 41(2) serving as the reference head by a time necessary for moving the head unit 40 by the "difference Ha2". In this way, it is possible to line up the dot-formed position in the transport direction by the end nozzles (that is, the end nozzles close to the third head) of the second head 41(2) on the front side in the sheet width direction and the dot-formed position in the transport direction by the end nozzles (that is, the end nozzles close to the second head) of the third head 41(3) on the rear side in the sheet width direction.

Figure 8B:
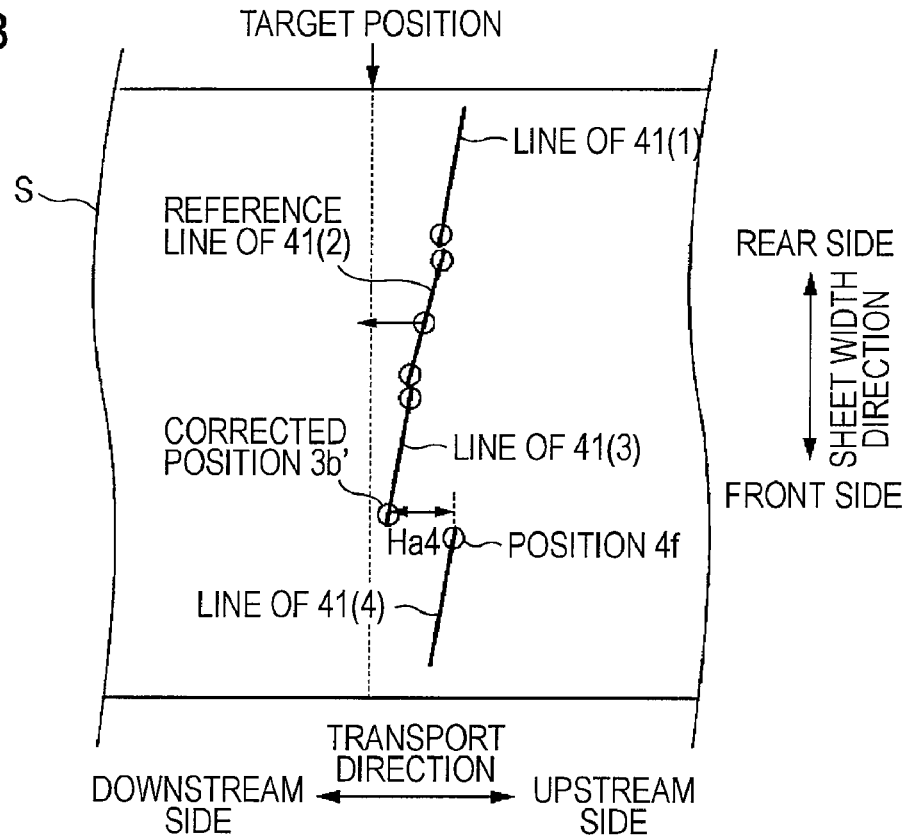
FIG. 8B is a diagram illustrating lines formed when the ejection times of first and third heads are corrected on the basis of the line formed by a second head.

FIG. 8B is a diagram illustrating lines formed when the ejection times of the first head 41(1) and the third head 41(3) are calculated on the basis of the line formed by the second head 41(2). The positions of the end portions of the lines formed in the transport direction by the first head 41(1) to the third head 41(3) are provided. The ejection times of the first head 41(1) and the third head 41(3) arranged in the sheet width direction along with the second head 41(2) are calculated on the basis of the ejection time of the second head 41(2) serving as the reference head, and then the ejection times of the remaining heads 41 are sequentially calculated on the basis of the ejection time of the second head 41(2).

For example, in order to calculate the ejection time of the fourth head 41(4) arranged on the front side in the sheet width direction from the third head 41(3) of which the ejection time is calculated, a position "4*f*" of the end portion of the line formed in the transport direction by the end nozzles (#1 to #10) of the fourth head 41(4) on the rear side in the sheet width direction is calculated. In addition, a correction value is calculated to line up the dot-formed position of the end nozzles of the third head 41(3) on the front side and the dot-formed position of the end nozzles of the fourth head 41(4) on the rear side. As shown in FIG. 8A, a difference "Ha3" is a deviation amount between the position "3*b*" of the end portion of the line on the front side formed by the third head 41(3) and the position "4*f*" of the end portion of the line on the rear side formed in the transport direction by the fourth head 41(4). However, the line formed by the third head 41(3) is formed at the position shown in FIG. 8B in order to line up the end portion of the line third head 41(3) and the end portion of the second head 41(2) serving as the reference head.

The ejection time of the fourth head 41(4) is corrected to locate the end portion of the line on the rear side formed by the forth head 41(4) to a position "3*b*'" of the end portion of the line on the front side formed by the third head 41(3) on the basis of the second head 41(2). A difference between the position 3*b*' of the end portion of the line on the front side formed by the corrected third head 41(3) and the position 4*f* of the end portion of the line on the rear side formed by the fourth head 41(4) is "Ha4". The difference "Ha4" corresponds to a difference between the difference "Ha3" between the position 3*b* of the end portion of the line on the front side formed by the third head 41(3) before the correction and the position 4*f* of the end portion on the rear side formed by the fourth head 41(4) and the difference "Ha2" between the position 3*f* of the end portion of the line on the rear side formed by the third head 41(3) before the correction and the position 2*b* of the end portion of the line on the front side formed by the second head 41(2). The line formed by the fourth head 41(4) is located on the upstream side in the transport direction from the corrected third head 41(3).

Accordingly, the ejection time of the fourth head 41(4) is advanced than the ejection time of the second head 41(2) serving as the reference head by a time necessary for moving the head unit 40 by the "difference Ha4". In this way, it is possible to line up the dot-formed position in the transport direction by the end nozzles (that is, the end nozzles close to the fourth head) of the third head 41(3) on the front side in the sheet width direction and the dot-formed position in the transport direction by the end nozzles (that is, the end nozzles close to the third head) of the fourth head 41(4) on the rear side in the sheet width direction.

The correction value (the adjustment amount of the ejection time) for the ejection time of the second head 41(2) serving as the reference head is calculated so as to provide the positions of the dots formed in the transport direction by the end nozzles of the adjacent heads 41 in order from the second head 41(2) serving as the reference head. In this way, it is possible to adjust the positions of the end portions of the lines formed by the first head 41(1) to the fourth head 41(4) arranged in the sheet width direction.

Here, since the second head 41(2) serves as the reference head, the ejection time is corrected from the designed ejection time so that the dot-formed positions formed by the end nozzles of the heads 41 adjacent to each other in the sheet width direction are provided on the basis of the line formed by the second head 41(2). Accordingly, the ejection time of the second head 41(2) may be corrected from the designed ejection time so that the middle portion of the line formed by the second head 41(2) is located at the target position.

For example, in FIG. 8B, the line formed by the second head 41(2) is formed on the upstream side in the transport direction from the target position. For this reason, the ejection time of the second head 41(2) may be advanced than the designed ejection time by a time a corresponding to a deviation amount between the target position and the middle portion of the line formed by the second head 41(2). That is, the time a by which the ejection time of the second head 41(2) is advanced from the designed ejection time corresponds to the correction value (first correction value) of the second head 41(2) at the time of forward movement.

Accordingly, the ejection time of the other heads 41 calculated on the basis of the second head 41(2) is also advanced by the time $\alpha$. For example, the ejection time of the first head 41(1) may be delayed than the designed ejection time by a difference between the time $\alpha$ and a time T during which the head unit 40 is moved by the difference Ha1. In addition, a time ($T-\alpha$) by which the ejection time is delayed corresponds to the correction value (first correction value H1) of the first head 41 at the time of forward movement. The method of lining up the middle portion of the line formed by the second head 41(2) serving as the reference head to the target position is not limited. For example, a correction value may be calculated so that the middle portion of the line formed by the second head 41(2) is lined up to the average position of the lines formed in the transport direction by the heads 41.

Figure 8C:
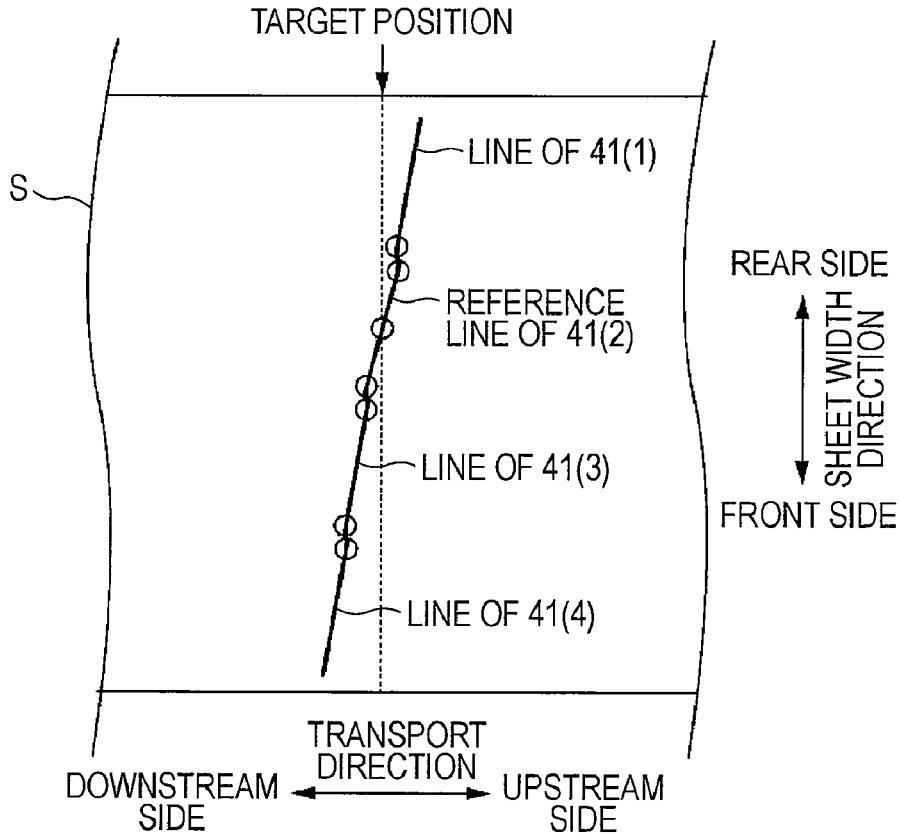
FIG. 8C is a diagram illustrating lines formed by correcting the ejection times of the heads.

FIG. 8C is a diagram illustrating the line formed by correcting the ejection times of the heads 41(1) to 41(4). In this way, by the method of correcting the dot-formed position according to this embodiment, it is possible to line up the positions of the dots formed in the transport direction by the end nozzles (joints) of the heads 41 arranged in the sheet width direction at the time of forward movement. Accordingly, it is possible to prevent the deterioration in the image formed in the joints of the heads 41 at the time of forward movement, compared to the image (see FIG. 6B) formed by the method of correcting the dot-formed position according to the comparative example.

In the printer 1 according to this embodiment, as shown in FIG. 5, the entire head unit 40 easily becomes tilted during the movement of the head unit 40 in the transport direction and the heads 41 belonging to the head unit 40 may become titled in the same direction. In this case, in the correcting method according to this embodiment, all of the lines formed at the time of forward movement by the plurality of heads 41 belonging to the head unit 40 become tilted clockwise with respect to the sheet width direction, as shown in FIG. 8C. In FIG. 8C, the line formed by the head (for example, the first head 41(1)) on the rear side in the sheet width direction is located on the upstream side in the transport direction. Moreover, the line formed by the head (for example, the fourth head 41(4)) on the front side in the sheet width direction is located on the downstream side in the transport direction. However, since the tilt occurring during the movement of the head unit 40 is adjusted to some extent in the process of manufacturing the printer 1, the tilt is not large. For this reason, the lines formed by the entire head unit 40 are not tilted in the sheet width direction to the degree that a user can easily recognize the tilt of the lines.

The head 41 (here, the second head 41(2)) in the middle of the plurality of heads 41 arranged in the sheet width direction is set to the reference head 41 and the ejection time of the reference head 41 is corrected so that the middle portion of the line formed by the reference head 41 is located at the target position. In this way, it is possible to reduce the deviation amount between the target position and the respective lines formed by the head (for example, the first head 41(1)) on the rear side in the sheet width direction and by the head (for example, the fourth head 41(4)) on the front side in the sheet width direction among the plurality of heads 41 arranged in the sheet width direction.

Here, in order to line up the positions of the dots formed in the transport direction by the end nozzles of the heads 41 arranged in the sheet width direction, the ejection times of the other heads 41 are calculated on the basis of the ejection time of the second head 41(2) serving as the reference head, and then the ejection time (time a) used to correct the deviation between the target position and the line formed by the second head 41(2) serving as the reference head is additionally calculated. However, the invention is not limited thereto. For example, the correction value H of the ejection time may be calculated from a difference between the end position of the line formed by the corrected second head 41 and the end position of the line formed by another head 41 by delaying the reading data of the line formed by the second head 41(2) serving as the reference head for the reading data obtained by reading the test pattern by a scanner.

Figure 9:
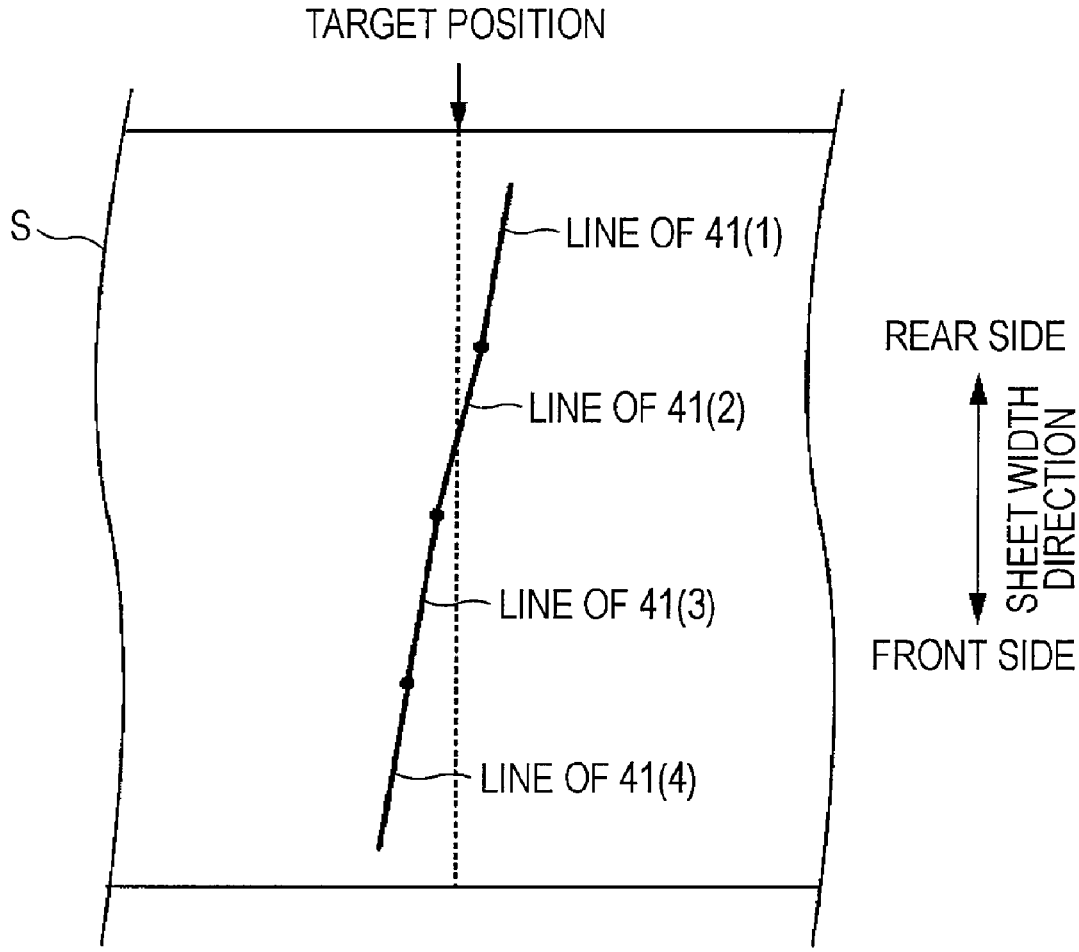
FIG. 9 is a diagram illustrating the positions of a dot formed in the transport direction by one nozzle in the end portion of the nozzle row.

FIG. 9 is a diagram illustrating the positions of the dots formed in the transport direction by one nozzle in the end portion of the nozzle row. As described above, the dot-formed positions of the heads 41 adjacent to each other in the sheet width direction are corrected on the basis of the average value of the positions of the dots formed in the transport direction by the plurality of end nozzles (ten nozzles) of the nozzle row of each head 41. However, the invention is not limited thereto. The dot-formed positions of the heads 41 adjacent to each other in the sheet width direction may be corrected on the basis of the position of the dot formed in the transport direction by one nozzle (#1 or #180) located on the most end of the nozzle row. For example, the dot-formed positions of the first head 41(1) and the second head 41(2) are corrected so as to provide the position of the dot formed in the transport direction by end nozzle #180 of the first head 41(1) on the front side and the position of the dot formed in the transport direction by end nozzle #1 of the second head 41(2) on the rear side. In this way, it is possible to reliably remove the difference in the lines, which are formed at the time of forward movement, in the image formed in the transport direction at the joints (end nozzles) of the heads 41.

When the end nozzles overlap with each other in the joints of the heads 41, the dot-formed position of one nozzle located at the most end of the nozzle row among the nozzles (that is, the nozzles being used) ejecting the ink may be corrected as the reference, or the dot-formed position of any one of the plurality of nozzles belonging to the overlapping area of the end nozzles may be corrected as the reference.

However, when the head unit 40 becomes tilted during the movement of the head unit 40 and thus the heads 41 belonging to the head unit 40 become tilted in the same direction, as in the printer 1 according to this embodiment, the lines formed by the heads 41 are tilted in the same direction. As shown in FIG. 8C or 9, the lines formed by all of the heads 41 belonging to the head unit 40 become tilted in the same direction with respect to the sheet width direction. Since the dots formed by the nozzles (#1 and #180) located at the most end of the nozzle row are deviated to the most degree in the transport direction, the tilt of the lines formed by all of the heads 41 is larger by adjusting the dot-formed position of each head 41 on the basis of the nozzle located at the most end. That is, the tilt of the line (see FIG. 9) printed when corrected at the dot-formed position of one end nozzle is larger than the tilt of the line (see FIG. 8C) printed when corrected on the basis of the average value of the dot-formed positions of the plurality of end nozzles. In other words, by correcting the dot-formed position of each head 41 on the basis of the average value of the dots formed by the plurality of end nozzles, it is possible to make the tilt of the lines formed by the entire head unit 40 gentle.

After the correction value of the dot-formed position of each head 41 is calculated at the time of forward movement, the correction value of the dot-formed position of each head 41 is calculated at the time of backward movement.

Figure 10A:
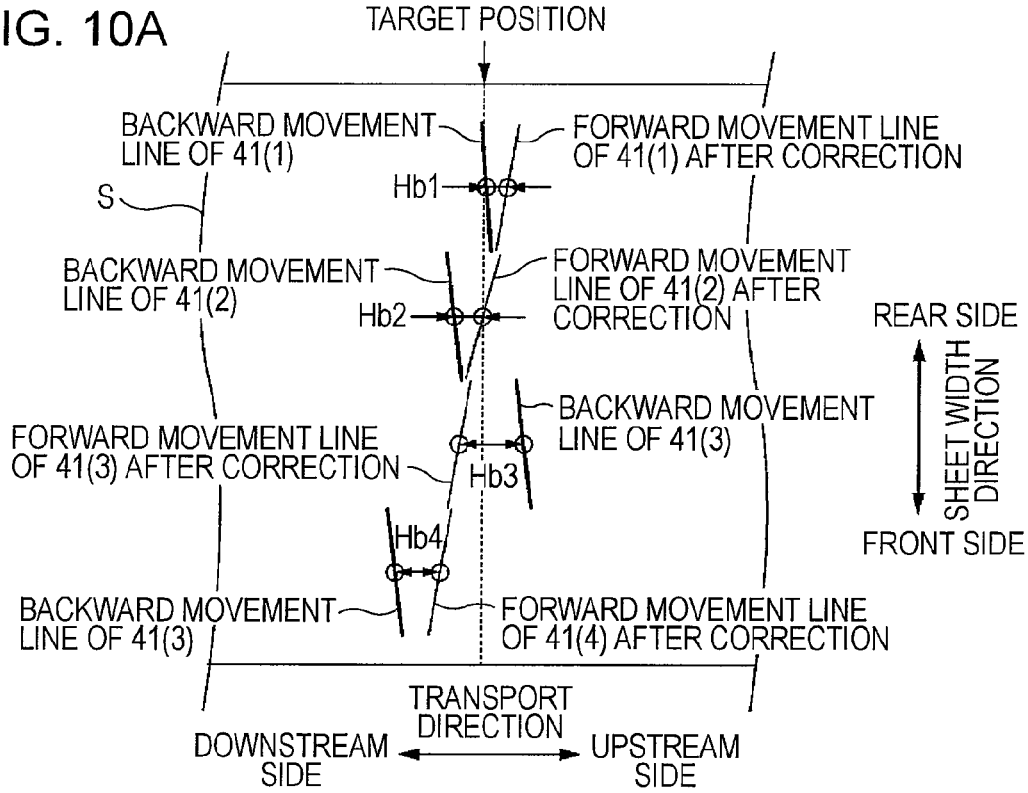
FIG. 10A is a diagram illustrating a test pattern formed to calculate a correction value at time of backward movement.

FIG. 10A is a diagram illustrating a test pattern formed to calculate a correction value at the time of backward movement. The ink droplets are ejected to the target position on the medium S from the heads 41 at the time of forward movement by correcting the ejection time in accordance with the correction value H1 at the time of forward movement, and then the ink droplets are ejected at the designed ejection time to the same target position from the heads 41 at the time of backward movement (S005 in FIG. 7).

As a consequence, forward movement lines and backward movement lines (indicated by a thick line and corresponding to a second pattern) formed by the heads 41(1) to 41(4) are formed as the test pattern. When the test pattern is formed, it is assumed that the head unit 40 is not moved in the sheet width direction during the forward movement and the backward movement. In addition, like the test pattern at the time of forward movement, reading data of a backward movement pattern is acquired by reading the test pattern at the time of backward movement by a scanner (S006). In the printer 1 according to this embodiment, as shown in FIG. 5, the head unit 40 at the time of backward movement easily becomes tilted counterclockwise. For this reason, the lines formed at the time of backward movement also become tilted counterclockwise with respect to the sheet width direction.

In the printer 1 according to this embodiment, however, since the printing is performed in such a manner that the head unit 40 is not moved in the sheet width direction during the forward movement and the backward movement, the dots are also formed at the time of backward movement in the same area where the dots are formed on the medium S at the time of forward movement. Accordingly, when the dots formed at the time of forward movement are deviated in the transport direction from the dots formed at the time of backward movement, an image thus deteriorates.

Here, the correction value for the dot-formed position of each head 41 at the time of backward movement is used as a correction value for lining up the dots formed in the transport direction at the time of forward movement and the dots formed in the transport direction at the time of backward movement to the same position in the sheet width direction on the medium S. In this embodiment, the ink droplets ejected from a certain head 41 at the time of backward movement are landed to the area where the ink droplets are ejected from the certain head 41 at the time of forward movement. Accordingly, the correction value for the dot-formed position of each head 41 at the time of backward movement is determined for the test pattern at the time of backward movement, as shown in FIG. 10A, so as to provide the positions of the lines formed in the transport direction at the time of forward movement and the time of backward movement by the same head 41. Moreover, the correction value is determined so as to provide the middle portions of the lines formed at the time of forward movement and the time of backward movement by the same head 41.

For example, the line formed by the first head 41(1) at the time of backward movement is formed at a position relatively close to the target position, like the forward movement line formed by the first head 41(1) before the correction, as shown in FIG. 8A. As shown in FIG. 10A, the forward movement line corrected in accordance with the correction value H1 at the time of forward movement is formed at a position on the upstream side in the transport direction from the target position. Here, there is calculated a difference "Hb1" between the position of the middle portion of the backward movement line formed in the transport direction by the first head 41(1) and the position of the middle portion of the forward movement line formed in the transport direction by the first head 41(1) after the correction (S007).

The ejection time of the first head 41(1) at the time of forward movement may be advanced from the designed ejection time by a time necessary for moving the head unit 40 by the difference Hb1. In this way, it is possible to line up the middle portion of the line formed at the time of forward movement by the first head 41(1) and the middle portion of the line formed at the time of backward movement thereby. The time by which the ejection time of the first head 41(1) at the time of backward movement is advanced from the designed ejection time corresponds to the correction value H2 of the first head 41(1) (S008).

Likewise, the line formed by the second head 41(2) at the time of backward movement is deviated on the upstream side in the transport direction from the target position. On the other hand, the line corrected at the time of forward movement by the second head 41(2) is formed at the target position. Here, the ejection time of the second head 41(2) at the time of backward movement may be advanced from the ejection time by a time necessary for moving the head unit 41 by a difference "Hb2" between the middle portion of the forward movement line corrected by the second head 41(2) and the middle portion of the backward movement line. In this way, it is possible to line up the middle portion of the line formed at the time forward movement by the second head 41(2) and the middle portion of the line formed at the time of backward movement thereby. Likewise, the correction value H2 at the time of backward movement of the other heads 41 is calculated so as to line up the middle portion of the forward movement line formed by each head 41 and the middle portion of the backward movement line formed thereby.

Figure 10B:
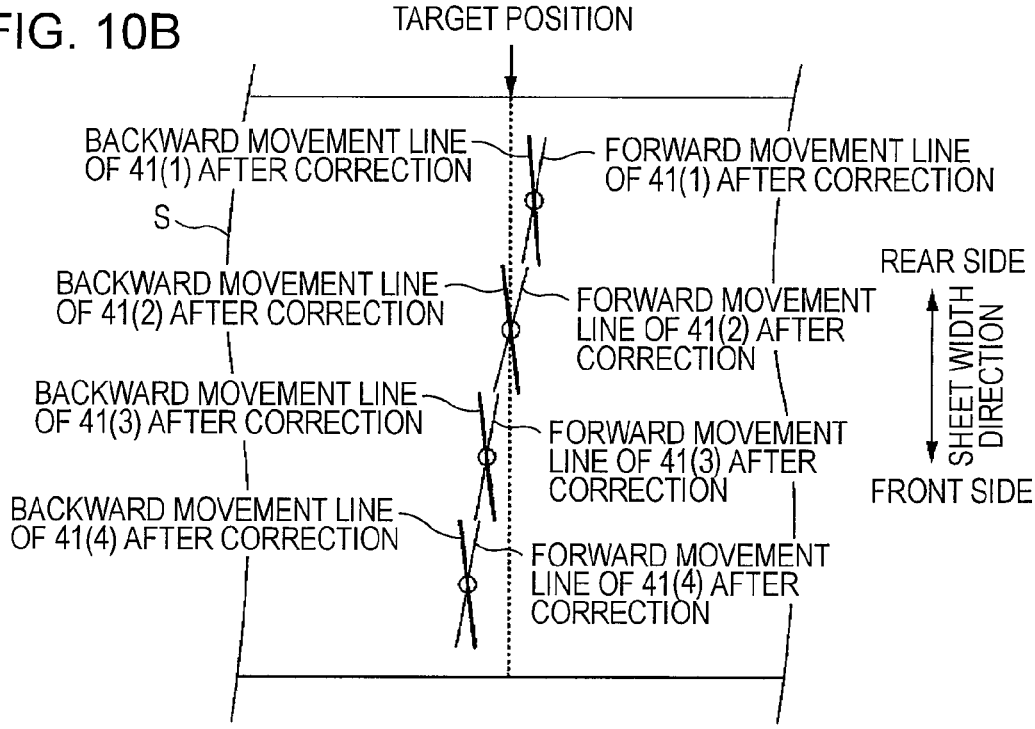
FIG. 10B is a diagram illustrating a forward movement line corrected in accordance with a correction value at the time of forward movement and a backward movement line corrected in accordance with a correction value at the time of backward movement.

FIG. 10B is a diagram illustrating a forward movement line corrected in accordance with the correction value H1 at the time of forward movement and a backward movement line corrected in accordance with the correction value H2 at the time of backward movement. The middle portion of the forward movement line formed by each head 41 and the middle portion of the backward movement line formed thereby are provided in the transport direction. Accordingly, it is possible to prevent the deviation in an image formed at the time of forward movement and an image formed at the time of backward movement in the transport direction.

That is, in the method of correcting the dot-formed positions in the transport direction according to this embodiment, the correction value H1 is calculated at the time of forward movement so as to provide the positions of the dots formed in the transport direction by the end nozzles (joints) of the heads 41 arranged in the sheet width direction. In addition, the correction value H2 is calculated at the time of backward movement so as to provide the positions of the dots formed in the transport direction by the middle nozzles of the heads 41 forming the dots at the same areas at the time of forward movement and the time of backward movement. In this way, it is possible to prevent the large deviation in the joints of the lines formed in the transport direction by the heads 41 at the time of forward movement. Moreover, it is possible to prevent the large deviation in the lines formed in the transport direction at the same areas at the time of forward movement and the time of backward movement. As a consequence, it is possible to prevent the deterioration of an image.

Figure 11:
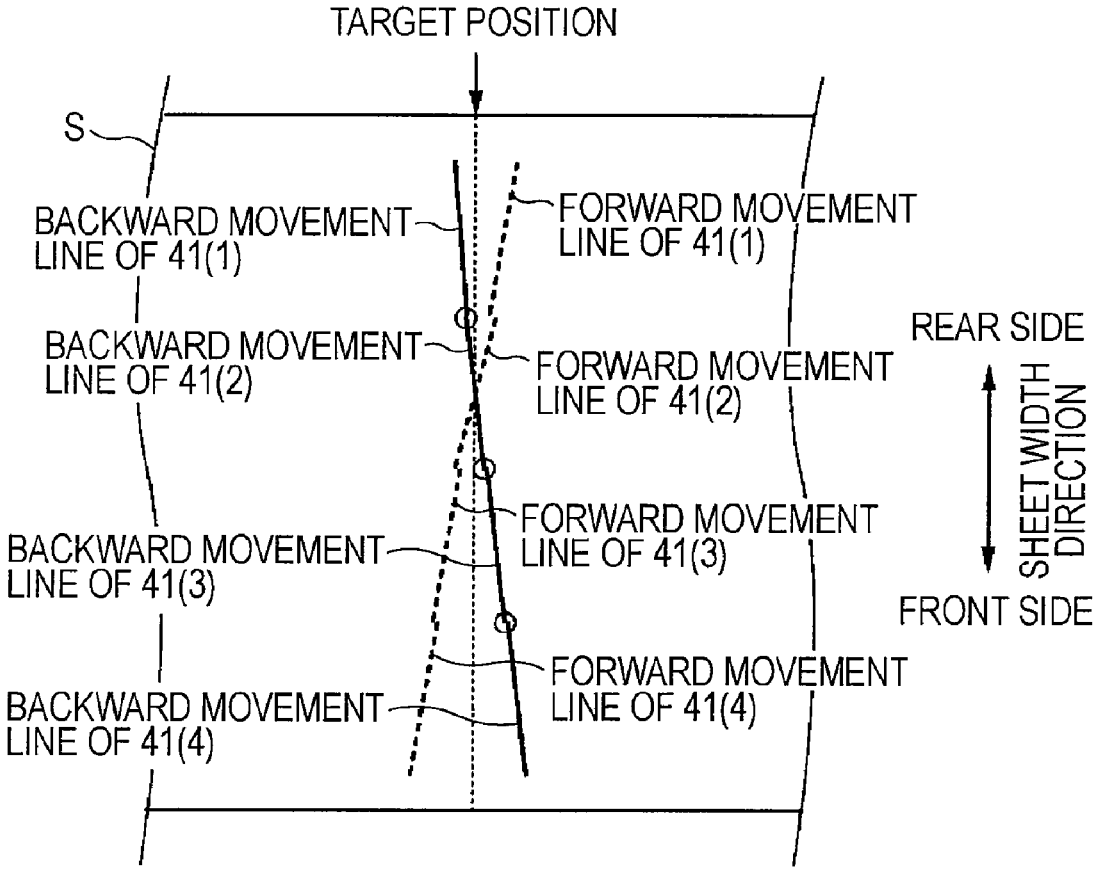
FIG. 11 is a diagram illustrating backward movement lines when the dot-formed positions of the end nozzles of the heads adjacent to each other are corrected in the sheet width direction according to a comparative example.

FIG. 11 is a diagram illustrating the backward movement line when the dot-formed positions of the end nozzles of the heads 41 adjacent to each other in the sheet width direction, as in the forward movement line, according to a comparative example. Here, it is assumed that the correction value H2 at the time of backward movement is also calculated for the lines at the time of backward movement so that the positions of the dots formed in the transport direction by the end nozzles of the heads 41 adjacent to each other. When the tilt of the head unit 40 at the time of forward movement is different from that at the time of backward movement, as in FIG. 5, the lines (indicated by a dot line) formed by the entire head unit 40 at the time of forward movement are tilted clockwise with respect to the sheet width direction and the lines (indicated by a full line) formed by the entire head unit 40 at the time of backward movement are tilted counterclockwise with respect to the sheet width direction, as in FIG. 11. For this reason, a difference becomes large between the lines formed at the time of forward movement and the lines formed at the time of backward movement in the transport direction by the head (for example, the fourth head 41(4)) on the rear side or the front side in the sheet width direction.

In the correcting method according to this embodiment, the positions of the dots formed in the transport direction by the middle nozzle of each head 41 forming the dots at the same area at the time of forward movement and the time of backward movement are lined up to calculate the correction value H2 at the time of backward movement (in FIG. 10B, the middle portion of the forward movement line and the middle portion of the backward movement line formed by the same head 41 are lined up). In this way, it is possible to prevent the large deviation between the lines formed at the time of forward movement and the lines formed at the time of backward movement.

In the method of correcting the dot-formed position according to this embodiment, when the tilt of the head unit 40 at the time of forward movement is different from that at the time of backward movement, the joints of the lines formed at the time of backward movement become deviated from each other in the transport direction, as in FIG. 10B. When the dot-formed position of the middle nozzle of each head 41 is corrected at the time of forward movement or at the time of backward movement on the basis of the reference either, as in the comparative example, the joints of the lines formed at the time of forward movement by the heads 41 are deviated from each other in the transport direction and the joints formed at the time of backward movement by the heads 41 are also deviated from each other in the transport direction, as shown in FIG. 6B. However, in this embodiment, since the positions of the dots formed in the transport direction by the end nozzles of each head 41 are provided at the time of forward movement, it is possible to improve an image quality, compared to the comparative example.

When the tilts of the lines formed at the time of forward movement and the time of backward movement are the same as each other, the positions of the dots formed in the transport direction at the joints of the heads 41 can be lined up in both the lines formed at the time of forward movement and the line formed in the transport direction at the backward movement. In the correcting method according to the comparative example, however, even when the tilts of the lines at the time of forward movement and the time of backward movement are the same as each other, the positions of the dots formed at the joints of the heads 41 may considerably be deviated from each other.

When the tilts of the head unit 40 at the time of forward movement and the time of backward movement are different from each other, the lines at the time of forward movement intersect the lines at the time of backward movement, as in FIG. 10B. This problem may also arise when the lines are formed in the correcting method according to the comparative example. However, when the tilts of the lines formed at the time of forward movement and the time of backward movement are the same as each other, it is possible to prevent the lines at the time of forward movement from intersecting the lines at the time of backward movement. Accordingly, in the process of manufacturing the printer 1, it is preferable to adjust the tilt of the head unit 40 occurring during the movement of the head unit 40 in the transport direction as small as possible.

The invention is not limited to the case where the dot-formed position is determined on the basis of the reference by the end nozzles of the heads 41 arranged in the sheet width direction when the correction value H1 at the time of forward movement is calculated. The dot-formed positions of the end nozzles of the heads 41 arranged in the sheet width direction may be determined on the basis of the reference when the correction value H2 at the time of backward movement is calculated. That is, the correction value H2 at the time of backward movement may be calculated so that the end portions of the lines formed by the heads 41 at the time of backward movement, and the correction value H1 at the time of forward movement may be calculated so that the middle portions of the lines formed at the time of forward movement and the time of backward movement by the heads 41.

When the head unit 40 becomes tilted during the movement of the head unit 40 in the transport direction and thus the heads 41 belonging to the head unit 40 become tilted in the same direction, like the printer 1 according to this embodiment, the lines formed by the entire head unit 40 become tilted in the sheet width direction, as in FIG. 8C, upon lining up the dot-formed positions of the end nozzles of the heads 41 arranged in the sheet width direction. For this reason, when the correction value is calculated in the case where the tilt of the head unit 40 (the base plate BP) in the sheet width direction is small at the time of forward movement and the time of backward movement during the movement of the head unit 40 in the transport direction, the dot-formed positions of the end nozzles of the heads 41 arranged in the sheet width direction may serve as a reference. In this way, the tilt of the lines formed by the entire head unit 40 can be made small. Moreover, when the correction value is calculated in the case where the tilt of the head unit 40 is large during the movement of the head unit 40, it is possible to prevent the lines formed by the entire head unit 40 from becoming tilted since the central portions of the lines formed in the same area at the time of forward movement and the time of backward movement are used as the reference. The invention is not limited to the case where the entire tilts of the head unit 40 (the base plate BP) are compared to each other. The dot-formed positions of the end nozzles of the heads 41 arranged in the sheet width direction may be used as the reference, when the correction value is calculated in a case where the sum amount of the tilts of the heads 41 belonging to the head unit 40 in the sheet width direction is small at the time of forward movement or time of backward movement or in a case where the maximum value of the tilts of the heads 41 belonging to the head unit 40 is small.

In the printer 1 according to this embodiment, the head unit 40 is not moved in the sheet width direction between the time of forward movement and the time of backward movement. However, the invention is not limited thereto. The head unit 40 may be moved slightly in the sheet width direction between the time of forward movement and the time of backward movement. For example, the head unit 40 may be moved only by the half pitch of the nozzle pitch 180 dpi between the time of forward movement and the time of backward movement to print an image with a high resolution. In this case, the head 41 ejecting the ink droplets to the same area at the time of forward movement and the time of backward movement is the same. Accordingly, in order to calculate the correction value at the time of backward movement, the central portion of the line formed at the time of forward movement and the time of backward movement by the same head 41 may be used as the reference.

Depending on the printing method, the heads 41 ejecting the ink droplets to the area on the medium S at the time of forward movement is different from the heads 41 ejecting the ink droplets to the area on the medium S at the time of backward movement in some cases. For example, the third head 41(3) and the fourth head 41(4) eject the ink to the area on the medium S at the time of forward movement, and the head unit 40 is moved by a distance corresponding to two heads in the sheet width direction, and then the first head 41(1) and the second head 41(2) eject the ink to the area on the medium S at the time of backward movement. In this case, when the correction value H2 at the time of backward movement is calculated, the central portion of the line formed at the time of forward movement by the third head 41(3) and the central portion of the line formed at the time of backward movement by the first head 41(1) may be provided, and the central portion of the line formed at the time of forward movement by the fourth head 41(4) and the central portion of the line formed at the time of backward movement by the second head 41(2) may be provided.

An image (corresponding to an image with a predetermined width called a band image below) with a length of the head unit 40 in the sheet width direction is formed by ejecting the ink droplets from the head unit 40 at the time of forward movement and by ejecting the ink droplets to the same area from the head unit 40 also at the time of backward movement without moving the head unit 40 in the sheet width direction (or moving the head unit 40 slightly in the sheet width direction). After the band image is formed, the head unit 40 is moved by a distance corresponding to the width of the band image in the sheet width direction by the Y-axis stage 32 (see FIG. 2B). In this way, the band image is printed again at a position different from the previous position. When the correction is performed on the basis of the dot-formed positions of the end nozzles of the heads 41 arranged in the sheet width direction in the case where the entire head unit 40 is tilted, as described above, the lines formed at the time of forward movement by the entire head unit 40 become tilted, as in FIG. 8C. Here, the print start position of the band image being printed at the next time of forward movement and the next time of backward movement may be delayed so that the positions of the end portions of the band image formed in the transport direction at the previous time of forward movement and the previous time of backward movement are lined up with the positions of the end portions of the band image formed in the transport direction at the next time of forward movement and the next time of backward movement. That is, a correction value (corresponding to a third correction value) is calculated to line up the positions of the dots formed by the fourth head 41(4) on the most front side in the sheet width direction upon printing the previous band image and the positions of the dots formed by the first head 41(1) on the most rear side in the sheet width direction upon printing the next band image.

The correction values H1 and H2 at the time of forward movement and the time of backward movement may be calculated in each of the nozzle rows YMCK (each color) or may be calculated in each head 41. Since the dots of the color ink YMC are superimposed, the dots of the respective colors are formed in the same pixels even in a case where different correction values are used in all of the nozzle rows. When the test pattern shown in FIG. 8A is formed to calculate a correction value for each head 41, only a representative color (for example, black) may be used or the lines of a plurality of colors may be formed. Moreover, by forming the test patterns with a plurality of colors, a correction value reflecting the ejecting features of the respective ink may be calculated.

Test Pattern according to Modified Examples

In the above-described test pattern, only the lines formed at the time of forward movement are printed and the correction value at the time of forward movement is calculated so as to form the dot-formed positions of the end nozzles of the heads 41 arranged in the sheet width direction, as shown in FIG. 8A. Subsequently, as shown in FIG. 10A, the forward movement lines corrected in accordance with the correction value and the backward movement lines before the correction are printed and the correction value at the time of backward movement is calculated so as to provide the middle portion of the line formed at the time of forward movement by each head 41 and the middle portion of the line formed at the time of backward movement by each head 41. However, the invention is not limited thereto. When the test pattern is formed to calculate the correction value at the time of backward movement, only the lines at the time of backward movement may be formed without printing the corrected lines at the time of forward movement. When the correction value at the time of forward movement is calculated, the positions of the lines at the time of forward movement for the target position and the positions of the corrected lines at the forward movement are grasped. Accordingly, when the positions of the lines at the time of backward movement for the target position are acquired, the correction value can be calculated to line up the middle portions of the corrected lines at the time of forward movement and the middle portions of the lines at the time of backward movement.

Figure 12A:
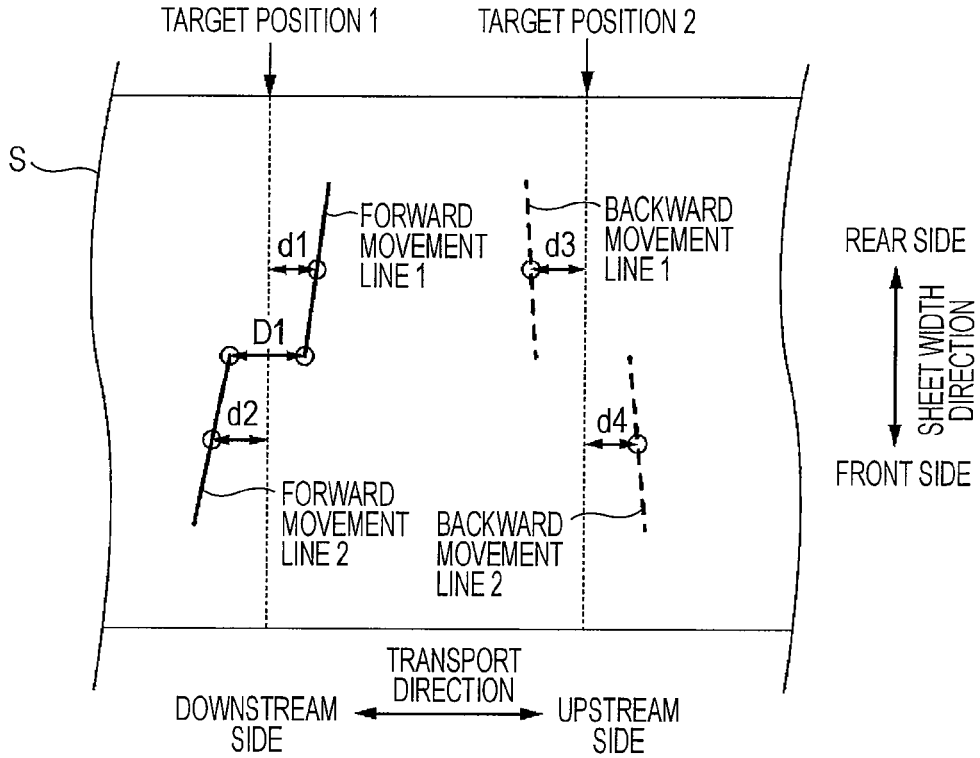
FIGS. 12A and 12B are diagrams illustrating test patterns used to calculate a correction value for the dot-formed position of each head in the transport direction according to a modified example.
Figure 12B:
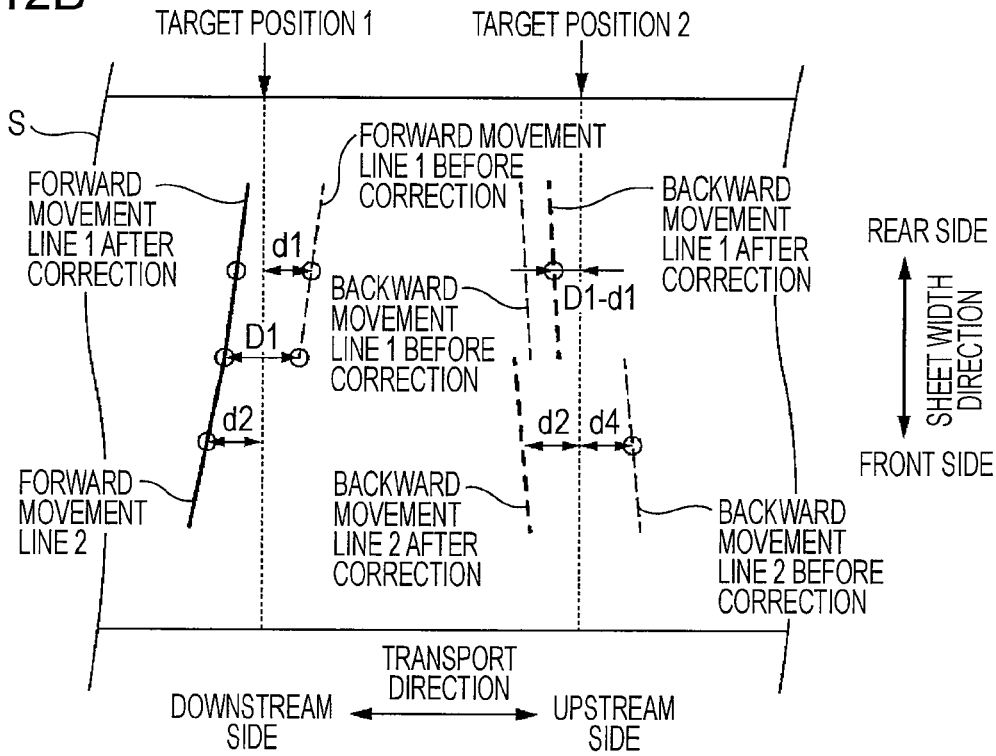

FIGS. 12A and 12B are diagrams illustrating test patterns used to calculate a correction value for the dot-formed position of each head 41 in the transport direction according to a modified example. As the test pattern used to calculate the correction value, the forward movement lines and the backward movement lines may be printed in the same print areas on the medium S, as shown in FIG. 12A. In this case, when the forward movement lines and the backward movement lines are printed at the same target positions, two lines are superimposed and thus the positions of the two lines in the transport direction may not be acquired. Accordingly, the forward movement lines and the backward movement lines may be printed on the basis of different target positions 1 and 2.

The correction value at the time of forward movement is calculated from the test pattern printed in this way so as to line up the end portion of the forward movement line formed by the reference head 41 with the end portions of the forward movement lines formed by the heads 41 arranged in the sheet width direction along with the reference head 41. For example, when forward movement line 2 shown in FIG. 12A is set to the line formed by the reference head 41, the correction value at the time of forward movement may be calculated so that forward movement line 1 arranged in the sheet width direction along with forward movement line 2 is formed on the downstream side in the transport direction by a deviation amount D1 in the transport direction between the end portion of forward movement line 2 and the end portion of forward movement line 1.

FIG. 12B is the diagram illustrating forward movement lines 1 and 2 corrected by the correction value at the time of forward movement. The correction value at the time of backward movement is calculated so as to provide the middle portions of the lines formed at the time of forward movement and the time of backward movement by the same head 41. Accordingly, the correction value at the time of backward movement may be calculated on the basis of the position of the middle portion of the forward movement line corrected on the basis of target position 1 and the position of the middle portion of the backward movement line corrected on the basis of target position 2. For example, since the middle portion of corrected forward movement line 1 is deviated by "D1-d1" toward the downstream side in the transport direction from target position 1, the correction value at the time of backward movement is calculated so that the middle portion of the backward movement line is also deviated by "D1-d1" toward the downstream side in the transport direction from target position 2. According to such a test pattern, it is possible to reduce the number of the test patterns formed or the number of times read by the scanner, compared to the above-described embodiment.

When the tilt of the lines formed by the entire head unit 40 is small during the time of forward movement and the time of backward movement, as described above, the correction value may be calculated on the basis of the dot-formed position of the end nozzles of the heads 41 arranged in the sheet width direction. Accordingly, as shown in FIG. 12A, by printing the forward movement lines and the backward movement lines in the same print area on the medium S, it is possible to determine the time at which the tilt of the lines formed by the entire head unit 40 is small during the time of forward movement and the time of backward movement.

Figure 13A:
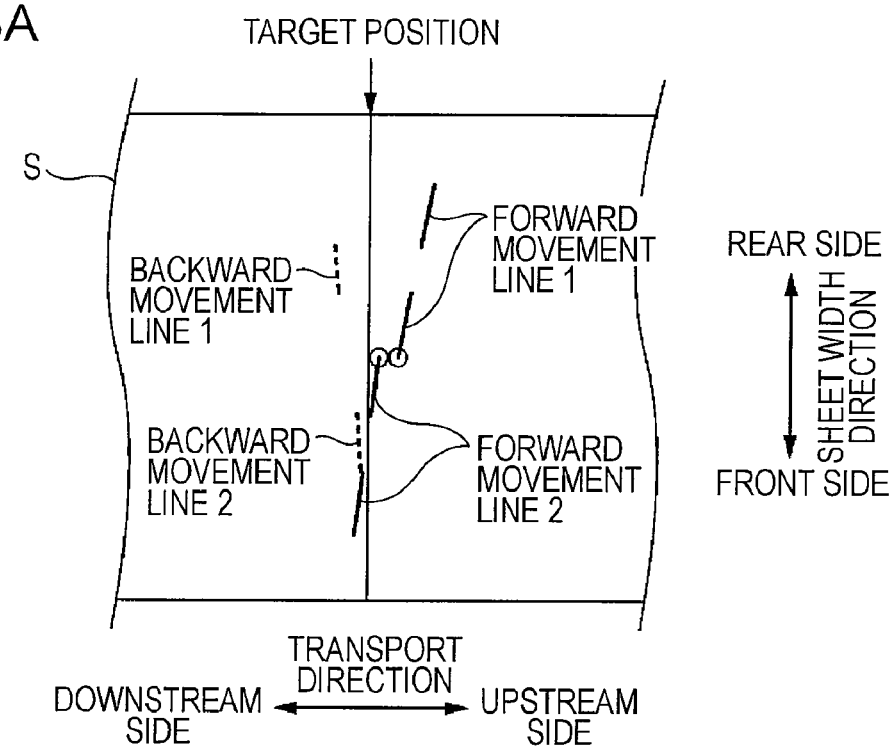
FIGS. 13A and 13B are diagrams illustrating test patterns used to calculate a correction value for the dot-formed position of each head in the transport direction according to a modified example.
Figure 13B:
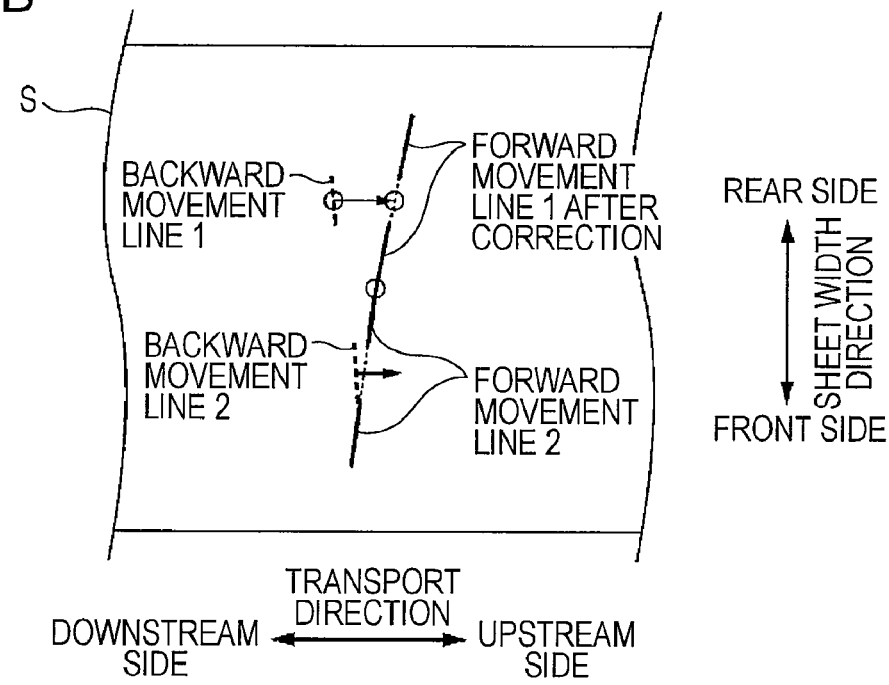

FIGS. 13A and 13B are diagrams illustrating test patterns used to calculate a correction value for the dot-formed position of each head 41 in the transport direction according to a modified example. In the test pattern shown in FIG. 13A, the forward movement lines and the backward movement lines are printed on the basis of the same target position. In order to line up the dot-formed positions of the nozzle ends of the heads 41 arranged in the sheet width direction when the correction value at the time of forward movement is calculated, the forward movement lines may be formed by the end nozzles on the rear side and the end nozzles on the front side in the sheet width direction and the backward movement lines may be formed by the middle nozzles of the nozzle rows. In FIG. 13A, the forward movement lines are indicated by a full line and the backward movement line are indicated by a dot line.

The correction value at the time of forward movement is first calculated so that the end portions of forward movement line 1 and forward movement line 2 formed in the sheet width direction are lined up together. In FIG. 13B, corrected forward movement lines 1 and 2 are shown. The correction value at the time of backward movement may be calculated so that the backward movement lines are located between the corrected forward movement lines.

In this way, by forming the lines only by the end nozzles at the time of forward movement on the basis of the dot-formed positions of the end nozzles and by forming the lines only by the middle nozzles at the time of backward movement on the basis of the dot-formed positions of the middle nozzles, it is possible to reduce the number of the test patterns formed and the number of times read by the scanner, compared to the above-described embodiment. Moreover, since the test pattern can be made small and the positions of the forward movement lines and the positions of the backward movement lines can be acquired on the basis of the target position, the correction value can easily be calculated.

Other Embodiments

In the above-described embodiment, the printing system including the ink jet printer has been mainly described, but disclosure regarding a method of adjusting the dot-formed position is included. The above-described embodiment has been described for easily understanding the invention and should not be construed as limiting the invention. The invention may be modified or improved without departing from the gist of the invention and includes the equivalents of the invention. In particular, the following embodiments are included in the invention.

Adjustment of Dot-Formed Position

In the above-described embodiment, as shown in FIG. 3, the plurality of heads 41 belonging to the head unit 40 are arranged in zigzags. Therefore, in consideration of the ejection characteristics of the respective heads 41, the correction value is calculated to line up the dot-formed positions of the heads 41 of which the positions are different in the transport direction. However, even when the plurality of heads 41 are not arranged in zigzags, the dot-formed positions may be deviated due to the ejection characteristics of the respective heads 41 in some cases. Therefore, the correction of the above-described dot-formed positions is preferably performed.

Other Printers

In the above-described embodiment, the printer performs the operation of forming an image on the continuous sheet transported in the print area during the movement of the plurality of heads 41 in the transport direction of the continuous sheet and the operation of moving the plurality of heads 41 in the sheet width direction intersecting the transport direction. However, the invention is not limited thereto. For example, a printer may be used in which the plurality of heads 41 have the sheet length and the plurality of heads 41 are not moved in the sheet width direction. Moreover, a serial type printer may be used which alternately repeats an operation of ejecting ink while moving the plurality of heads 41, which is arranged in the nozzle row direction, in a movement direction intersecting the nozzle row direction and an operation of transporting a sheet in the nozzle row direction.

Liquid Ejecting Apparatus

In the above-described embodiment, the ink jet printer has been exemplified as a liquid ejecting apparatus, but the invention is not limited thereto. The invention is applicable to various industrial apparatuses serving as a liquid ejecting apparatus as well as the printer (printing apparatus). For example, the invention is applicable to a printing apparatus attaching a shape to a cloth, a display manufacturing apparatus such as a color filter manufacturing apparatus or an organic EL display, a DNA chip manufacturing apparatus applying a solution with dissolved DNA to a chip to manufacture a DNA chip, or the like. The invention is not limited to an apparatus ejecting a liquid such as ink, but is applicable to a fluid ejecting apparatus ejecting a powder.

As a liquid ejecting method, a piezoelectric method may be used in which a liquid is ejected by applying a voltage to a driving element (piezoelectric element) and expanding or contracting an ink chamber, or a thermal method may be used in which bubbles are generated in nozzles by a heating device to eject a liquid by the bubbles.

What is claimed is:

1. A method of calculating a correction value in a liquid ejecting apparatus in which a plurality of heads is arranged in a predetermined direction and each of the heads has a nozzle row in which nozzles ejecting a liquid on a medium are arranged in the predetermined direction, the method comprising:

forming a first pattern by a first operation of ejecting the liquid from the plurality of heads while relatively moving the plurality of heads and the medium from one side of an intersecting direction intersecting the predetermined direction to the other side of the intersecting direction;

forming a second pattern by a second operation of ejecting the liquid from the plurality of heads while relatively moving the plurality of heads and the medium to the other side of the intersecting direction to the one side of the intersecting direction;

calculating, on the basis of the first pattern, a first correction value to line up a landed position of the liquid ejected in the first operation from an end nozzle of a certain head among the plurality of heads on one side of the predetermined direction and a landed position of the liquid ejected in the first operation from an end nozzle of another head on the other side of the predetermined direction, the another head being arranged on the one side of the predetermined direction along with the certain head; and calculating, on the basis of the first and second patterns, a second correction value to line up a landed position of the liquid ejected in the first operation from a middle nozzle of the certain head and a landed position of the liquid ejected from a middle nozzle of the another head ejecting the liquid in the second operation to the landed position of the liquid ejected from the certain head in the first operation.

2. The method according to claim 1, wherein the first correction value is calculated to line up an average position of landed positions of the liquid ejected in the first operation from a plurality of end nozzles of the certain head on the one side of the predetermined direction and an average position of landed positions of the liquid ejected in the first operation from a plurality of end nozzles of the another head on the other side of the predetermined direction.

3. The method according to claim 1, wherein the first correction value is calculated to line up a landed position of the liquid ejected in the first operation from one end nozzle located at the most end of the nozzle row of the certain head on the one side of the predetermined direction among the nozzles ejecting the liquid and a landed position of the liquid ejected in the first operation from one end nozzle located at the most end of the nozzle row of the another head on the other side of the predetermined direction among the nozzles ejecting the liquid.

4. The method according to claim 1, wherein in the liquid ejecting apparatus, the plurality of heads are mounted on one plate, and wherein a tilt of the plate with respect to the predetermine direction is smaller in the first operation than in the second operation during the relative movement of the plurality of heads and the medium in the intersecting direction.

5. The method according to claim 1, wherein a total amount of the tilts of the heads with respect to the predetermined direction is smaller in the first operation than in the second operation during the relative movement of the plurality of heads and the medium in the intersecting direction.

6. The method according to claim 1, wherein the first pattern is formed by ejecting the liquid to the target position on the medium from an end nozzle of each of the nozzle rows of the plurality of heads in the first operation, and wherein the second pattern is formed by ejecting the liquid to the target position from a middle nozzle of each of the nozzle rows of the plurality of heads in the second operation.

7. The method according to claim 1, wherein the liquid ejecting apparatus alternately repeats an image forming operation of forming images with a predetermined width by the first and second operation and a transporting operation of relatively moving the plurality of heads and the medium from the other side of the predetermined direction to the one side of the predetermined direction, and wherein a third correction value is calculated to line up the position of an end portion in the intersecting direction, which is located on the one side of the predetermined direction, in the image with the predetermined width formed in the previous image forming operation and the position of an end portion in the intersecting direction, which is located on the other side of the predetermined direction, in the image with the predetermined width formed in the next image forming operation.

8. A method of manufacturing a liquid ejecting apparatus in which a plurality of heads is arranged in a predetermined direction and each of the heads has a nozzle row in which nozzles ejecting a liquid on a medium are arranged in the predetermined direction, the method comprising:

forming a first pattern by a first operation of ejecting the liquid from the plurality of heads while relatively moving the plurality of heads and the medium from one side of an intersecting direction intersecting the predetermined direction to the other side of the intersecting direction;

forming a second pattern by a second operation of ejecting the liquid from the plurality of heads while relatively moving the plurality of heads and the medium to the other side of the intersecting direction to the one side of the intersecting direction;

calculating, on the basis of the first pattern, a first correction value to line up a landed position of the liquid ejected in the first operation from an end nozzle of a certain head among the plurality of heads on one side of the predetermined direction and a landed position of the liquid ejected in the first operation from an end nozzle of another head on the other side of the predetermined direction, the another head being arranged on the one side of the predetermined direction along with the certain head; and calculating, on the basis of the first and second patterns, a second correction value to line up a landed position of the liquid ejected in the first operation from a middle nozzle of the certain head and a landed position of the liquid ejected from a middle nozzle of the another head ejecting the liquid in the second operation to the landed position of the liquid ejected from the certain head in the first operation, whereby the landed position of the liquid ejected in the first operation from the end nozzle of the certain head on the one side of the predetermined direction and the landed position of the liquid ejected in the first operation from the end nozzle of the another head on the other side of the predetermined direction are lined up, and the landed position of the liquid ejected in the first operation from the middle nozzle of the certain head and the landed position of the liquid ejected from the middle nozzle of the another head ejecting the liquid in the second operation to the landed position of the liquid ejected from the certain head in the first operation are lined up.

* * * * *